US007463126B2

(12) United States Patent
Masuda et al.

(10) Patent No.: US 7,463,126 B2
(45) Date of Patent: Dec. 9, 2008

(54) MICRO ELECTROMECHANICAL SWITCH AND METHOD OF MANUFACTURING THE SAME

(75) Inventors: Takahiro Masuda, Kyoto (JP); Tomonori Seki, Nara (JP)

(73) Assignee: OMRON Corporation, Kyoto (JP)

( * ) Notice: Subject to any disclaimer, the term of this patent is extended or adjusted under 35 U.S.C. 154(b) by 150 days.

(21) Appl. No.: 11/375,518

(22) Filed: Mar. 14, 2006

(65) Prior Publication Data

US 2006/0208837 A1 Sep. 21, 2006

(30) Foreign Application Priority Data

Mar. 14, 2005 (JP) ..... 2005-071729
Jan. 25, 2006 (JP) ..... 2006-016973

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,115,231 A * 9/2000 Shirakawa ..... 200/181
6,628,183 B2 * 9/2003 Kang et al. ..... 333/262
6,847,277 B2 * 1/2005 Hsu et al. ..... 335/78
2002/0005341 A1 1/2002 Seki

FOREIGN PATENT DOCUMENTS

DE 42 05 029 C1 2/1993
DE 42 05 340 C1 5/1993
EP 0 520 407 12/1992
JP 11-111146 4/1999
JP 11-134998 5/1999
WO WO-99/62089 12/2000

OTHER PUBLICATIONS

Patent Abstracts of Japan; Publication No. 11-111146; Date of publication: Apr. 23, 1999.
Patent Abstracts of Japan; Publication No. 11-134998; Date of publication: May 21, 1999.
Extended European Search Report; dated Jun. 28, 2006; in application No. 06111126.6 (7 pages).
Sakata, Minoru; "An Electrostatic Microactuator for Electro-Mechanical Relay"; Proceedings IEEE Micro Electro Mechanical Systems; Feb. 20, 1989 (3 pages).

* cited by examiner

*Primary Examiner*—Elvin G Enad
*Assistant Examiner*—Bernard Rojas
(74) *Attorney, Agent, or Firm*—Osha • Liang LLP

(57) ABSTRACT

A micro electromechanical relay opens and closes an electrical circuit by contact/separation between a fixed contact disposed on a base and a movable contact disposed on an actuator by driving of a movable electrode by electrostatic attraction by application of voltage between a fixed electrode disposed on the base and a movable electrode of the actuator. The actuator comprises a supporting portion disposed on the base, a beam portion extending in a cantilevered manner from the supporting portion, and a movable electrode and a movable contact elastically supported by the beam portion. The beam portion elastically supports, in order from the supporting portion end, the movable electrode and the movable contact. A slit is formed from the side of the supporting portion in the portion of the actuator connecting the beam portion and the movable electrode.

19 Claims, 37 Drawing Sheets

*Fig. 8*

| File | Slit Length (μm) | Restorative Force (mN) | Contact Force (mN) (at 20V) | ACT Thickness (μm) |
|---|---|---|---|---|
| Cantilever Comparative Example | 0 | 0.85 | 0.21 | 19.46 |
| Cantilever Working Example (1) | 150 | 0.85 | 0.62 | 21.15 |
| Cantilever Working Example (2) | 205 | 0.84 | 1.27 | 21.15 |
| Cantilever Working Example (3) | 230 | 0.84 | 1.53 | 21.15 |
| Cantilever Working Example (4) | 250 | 0.84 | 1.89 | 21.15 |
| Cantilever Working Example (5) | 310 | 0.83 | 1.86 | 21.15 |
| Cantilever Working Example (6) | 400 | 0.81 | 1.85 | 21.15 |

*Prior Art*

PRIOR ART

PRIOR ART

*Prior Art*

PRIOR ART

*Prior Art*

MICRO ELECTROMECHANICAL SWITCH AND METHOD OF MANUFACTURING THE SAME

BACKGROUND OF INVENTION

1. Field of the Invention

The present invention relates to a micro electromechanical switch for opening and closing an electronic circuit by causing contact or separation between contacts using electrostatic attraction, a method for manufacture of such, and a device utilizing the micro electromechanical switch. In particular, the present invention relates to a structure of an actuator of a micro electromechanical switch.

2. Background Art

A conventional micro electromechanical relay, which is one type of a micro electromechanical switch, will be explained with reference to FIGS. 40-45. FIG. 40 shows schematically the conventional micro electromechanical relay. The micro electromechanical relay 100 comprises a base 101 and an actuator 111 having a portion thereof fixed to an upper face of the base 101 and also having the other portion separated from the base 101. Furthermore, within these figures, an element that is the same is designated by the same reference.

A fixed electrode 102 and a pair of signal lines 103 and 104 are disposed on the upper face of the base 101. The pair of signal lines 103 and 104 is aligned at a short distance. The opposing parts of the signal lines 103 and 104 form a pair of fixed contacts 103*a* and 104*a*, respectively.

The actuator 111 comprises a supporting portion 112, a beam portion 113, a movable electrode 114, and a movable contact portion 115. The supporting portion 112 is disposed on a surface of the base 101, extends upward therefrom, and supports the beam portion 113, the movable electrode 114, and the movable contact portion 115. The beam portion 113 extends from the supporting portion 112 as a cantilever beam for elastically supporting the movable contact portion 115 as well as for elastically supporting the movable electrode 114 through a connecting part 118. The movable contact portion 115 is disposed at a distal tip of the beam portion 113, and the movable electrodes 114 are disposed on both sides of the beam portion 113 through the connecting part 118. The connecting part 118, the beam portion 113, and the movable electrode 114 all have the same thickness.

The movable electrode 114 is disposed at a position opposite to the fixed electrode 102 of the base 101. Furthermore, an insulating film 110 is formed on the fixed electrode 112 for prevention of short circuiting between the fixed electrode 102 and the movable electrode 114. The movable contact portion 115 is disposed at a position opposing a region extending from the fixed contact 103*a* to the fixed contact 104*a*, and a movable contact 116 is disposed at a lower face of the movable contact portion 115. The movable contact 116 opposes each of the fixed contacts 103*a* and 104*a* and provides mutual electrical contact between the signal lines 103 and 104 by closing contact between the fixed contacts 103*a* and 104*a*.

FIGS. 41(*a*) and (*b*) show a state when a voltage is not applied between the fixed electrode 102 and the movable electrode 114. As shown by these figures, the fixed electrodes 103*a* and 104*a* are displaced from the movable contact 116, and the signal line 103 and the signal line 104 are mutually electrically separated.

FIGS. 42(*a*) and (*b*) show a state when a voltage is applied between the fixed electrode 102 and the movable electrode 114. As shown by these figures, the movable electrode 114 is driven toward the fixed electrode 102 by electrostatic attraction generated by the applied voltage. By way of this, the movable contact 116 comes into contact with the fixed contacts 103*a* and 104*a*, and the signal lines 103 and 104 become mutually electrically connected. In this state, the contact force required for stabilizing contact resistance between the movable contact 116 and the fixed contacts 103*a* and 104*a* needs to be imparted to the movable contact portion 115 by the electrostatic attraction.

When the voltage between the fixed electrode 102 and the movable electrode 114 stops, the electrostatic attraction disappears, and the actuator 111 returns to the original position, as shown in FIGS. 41(*a*) and (*b*), due to restorative force of the beam portion 113 and the movable electrode 114. At this time, a restorative force greater than the contact force between the movable contact 116 and the fixed contacts 103*a* and 104*a* needs to be imparted to the movable contact portion 115. This restorative force is determined by the elastic constant of the beam portion 113, the elastic constant of the contact part 118, and the inter-contact distance between the movable contact 115 and the fixed contacts 103*a* and 104*a*.

Operation of the movable electrode due to application of voltage is explained with reference to FIGS. 43 and 44. FIG. 43 shows the relevant components of the conventional micro electromechanical relay 100 shown in FIG. 40. Moreover, FIGS. 44(*a*)-(*d*) are cross-sectional diagrams, along the R-R line shown in FIG. 43 from the movable electrode 114 to the movable contact portion 115, showing movement of the movable electrode 114 due to electrostatic attraction.

The conventional movable electrode 114 operates in the below described manner. Specifically, when a voltage is not applied, the movable electrode 114 is disposed as shown in FIG. 44(*a*). Then, when a voltage is applied, firstly as shown in FIG. 44(*b*), the outer side of the movable electrode 114 is deformed toward the fixed electrode 102 due to electrostatic attraction. The electrostatic attraction between the electrodes (Fele) is expressed by the below listed equation:

$$Fele=(C\times Vs^2)/(2\times d) \tag{11}$$

Where C is the electrical capacitance, Vs is the applied voltage, and d is the inter-electrode distance.

Due to deformation of the movable electrode 114, the distance between the movable electrode 114 and the fixed electrode 102 becomes smaller, and thus the electrostatic attraction according to the equation (11) becomes larger. Accordingly, as shown in FIG. 44(*c*), the movable electrode 114 and the movable contact portion 115 move toward the base 101.

Due to movement of the movable electrode part 114 toward the base 101, the distance between the movable electrode 114 and the fixed electrode 102 becomes smaller, and the electrostatic attraction according to the equation (11) increases further. Thus, as shown in FIG. 44(*d*), the movable electrode 114 and the movable contact portion 115 moves further toward the base 101, and thereby the movable contact 116 comes into contact with the fixed contact 103*a*.

The amount of displacement of the actuator 111 due to application of voltage will be explained while referring to FIG. 45. FIG. 45 shows the results of a simulation of the amount of displacement when a voltage is applied to the conventional actuator 111. When points of equal amount of displacement are interconnected by contour lines, the amount of displacement is indicated by densities of dots within regions bounded by the contour lines and the profile of the movable electrode 114. Namely, the region without dots indicates the region of near zero amount of displacement, and the region of highest density of dots indicates the region of contact between the movable electrode 114 and the fixed electrode 102.

Referring to FIG. 45, for the conventional movable electrode 114, it may be understood that the amount of displacement is small, and there is no adherence to most portions of the fixed electrode.

[Patent citation 1] Unexamined Laid-open Patent Application H11-111146 (disclosed on Apr. 23, 1999)

[Patent citation 2] Unexamined Laid-open Patent Application H11-134998 (disclosed on May 21, 1999)

As discussed above, sufficient contact force and restorative force are required in order for the micro electromechanical relay 100 to operate normally. The voltage applied between the fixed electrode 102 and the movable electrode 114 may be increased in order to raise the contact force by increasing the electrostatic attraction. The below listed 3 methods have been considered for increasing the electrostatic attraction:

(Method A): The elastic constant is decreased by reduction of thickness of the beam portion 113 and the movable electrode 114, without changing the shapes of the beam portion 113 and the movable electrode 114 as viewed from above, and also the distance between the fixed electrode 102 and the movable electrode 114 at the time of application of voltage is decreased as much as possible.

(Method B): The applied voltage is raised.

(Method C): The dimensions of the fixed electrode 102 and the movable electrode 114 are increased.

However, when the elastic constant is decreased by method A, the restorative force also decreases. Thus, there would be concern that contact between the movable contact 116 and the fixed contacts 103*a* and 104*a* may continue even after stoppage of the application of voltage. Moreover, the methods B and C run counter to trends of technical progress toward lower voltage and further miniaturization.

In view of above, the present invention has an object of providing a micro electromechanical switch capable of improving the contact force while maintaining the restorative force, lowering the applied voltage, and/or decreasing dimensions of the electrode.

SUMMARY OF INVENTION

In accordance with one aspect of the present invention, a micro electromechanical switch allows a movable electrode to be driven by electrostatic attraction generated by a voltage applied between a mobile electrode of an actuator and a fixed electrode disposed on a base, and thereby the electrical circuit is opened or closed by causing contact or separation of a movable contact of the actuator with the fixed contact disposed on the base. In order to solve the above mentioned problems, the actuator comprises a supporting portion extending upward from the base and a beam portion, extending laterally from the supporting portion, that elastically supports the movable contact and elastically supports the movable electrode through a connecting part. The beam portion elastically supports, in order from the supporting portion, the movable electrode, and the movable contact. A slit is formed from the supporting portion side in the connecting part that interconnects the beam portion and the movable electrode.

By way of the configuration that the slit is formed in the connecting part, length of the actual connecting portion of the connecting part (i.e., length of the part that actually interconnects the beam portion and the movable electrode) is shorter than for the conventional micro electromechanical switch. Thus, the elastic constant of the connecting part supported by the beam portion is lowered. It thus becomes possible to increase the amount of displacement of the movable electrode by electrostatic attraction, and electrostatic attraction may further be increased by shortening of the distance between the movable electrode and the fixed electrode. Moreover, due to the increase of the electrostatic attraction, the force imparted to the beam portion from the movable electrode through the connecting part increases, and thus the contact force imparted to the fixed contact by the movable contact supported by the beam portion increases.

It is thus possible to decrease the elastic constant of the beam portion, and increase electrostatic attraction, while maintaining restorative force unchanged. Accordingly, it is possible to improve contact force while maintaining restorative force that is equivalent to that of the conventional micro electromechanical switch. If it is permissible that the contact force be equivalent to that of the conventional micro electromechanical switch, due to the ability to decrease the electrostatic attraction, it is then possible to lower the applied voltage. This may allow dimensions of the electrode to be downsized.

It is preferred that a length of slit is approximately 37% or more of the length of connecting part because of marked increase of the contact force. Further, the length of the slit is more preferably at least 60% the length of the connecting part because contact force is then in the vicinity of a maximum value. Furthermore, a slit length of approximately 70% to approximately 90% of the length of the connecting part is most preferred from the standpoint of maintaining strength of the actual connecting portion of the connecting part and from the standpoint of variance during manufacture.

In accordance with one aspect of the present invention, in order to solve the above mentioned problems, an actuator of a micro electromechanical switch comprises a supporting portion disposed on and extending upward from a base and a beam portion extending laterally from the supporting portion for elastically supporting a movable electrode through a connecting part and for elastically supporting a movable contact. The beam portion, in order from the supporting portion end, elastically supports the movable electrode, and the movable contact. Further, the connecting part that interconnects the beam portion and the movable electrode has a smaller elastic constant in comparison to the conventional connecting part that extends the entire length of the beam portion or the movable electrode.

By way of this configuration, the connecting part has a low elastic constant in comparison to the conventional connecting part that extends the entire length of the beam portion or the movable electrode, and thus the connecting part bends readily. Thus, the amount of displacement of the movable electrode due to static electricity increases, the distance between the movable electrode and the fixed electrode decreases, and there is a further increase of electrostatic attraction. Further, due to the increase of electrostatic attraction, the force imparted by the movable electrode through the connecting part to the beam portion increases, and contact force against the fixed contact by the movable contact supported by the beam portion increases.

Accordingly, by decreasing elasticity of the connecting part while maintaining the restorative force, it is possible to bring about an increase of electrostatic attraction. It is possible to improve contact force while maintaining restorative force that is equivalent to that used previously. If it is permissible for the contact force to be equivalent to that used previously, then it is possible to lower the electrostatic attraction, and thus it is possible to lower the applied voltage. This may allow dimensions of the electrode to be downsized.

In order to lower the elastic constant of the connecting part in comparison to the elastic constant of the conventional connecting part, the connecting part may be formed to be thinner than the beam portion and the movable electrode.

Alternatively, it is possible for the material and/or structure of the actual connecting portion to be different from those of the beam portion and the movable electrode. In this case, since the thickness or width of the actual connecting portion can be readily modified, the degree of freedom of design of the connecting part may be improved.

The micro electromechanical switch having the connecting part as discussed above may be manufactured by steps comprising: bonding an SOI wafer for forming the actuator onto a glass substrate for forming the base, etching the SOI wafer to expose a silicon oxide film, etching regions outside the region corresponding to the connecting part, and removing the silicon oxide film. Alternatively, etching of the SIO wafer may be carried out to form the supporting portion, and a metal film pattern may be formed in the region corresponding to the connecting part. Further, etching of the SIO wafer may be carried out to form the supporting portion, further etching of the SOI wafer may be carried out at the region corresponding to the connecting part to expose the silicon oxide film, and a metal film may be formed in the region corresponding of the connecting part.

In addition, the micro electromechanical switch as discussed above may be incorporated into various types of devices in order to open and close an electrical circuit. Examples of such devices that can be cited include: a wireless radio equipped with the micro electromechanical switch for opening and closing a signal line between an antenna and an internal circuit, a measuring instrument equipped with the micro electromechanical switch for opening and closing a signal line between an internal circuit and an object-to-be-measured, a temperature controller equipped with the micro electromechanical switch for opening and closing an electrical power supply line to an internal circuit of a temperature-controlled device based on temperature of a device under control, and a portable data terminal equipped with the micro electromechanical switch for opening and closing an internal electrical signal.

The micro electromechanical switch according to the present invention, as described above, allows the amount of displacement of the movable electrode by electrostatic attraction to be increased by way of forming of the slit in the connecting part or lowering elastic constant of the connecting part. Thus, the applied voltage can be decreased while improving contact force and while maintaining restorative force that is equivalent to that of the conventional connecting part. The present invention alternatively or additionally has the effect of making possible a decrease of the dimensions of the electrode.

BRIEF DESCRIPTION OF DRAWINGS

FIG. 2(*a*) is a cross-sectional drawing at the A-A line shown in FIG. 1 viewed in the direction of the arrows, and FIG. 2(*b*) is a cross-sectional drawing at the B-B line shown in FIG. 1 viewed in the direction of the arrows.

FIG. 3(*a*) is a cross-sectional drawing at the A-A line shown in FIG. 1 viewed in the direction of the arrows, and FIG. 3(*b*) is a cross-sectional drawing at the B-B line shown in FIG. 1 viewed in the direction of the arrows.

FIG. 8 is a table showing the relationship between the contact force and slit length for a micro electromechanical relay according to an embodiment of the present invention.

FIG. 20(*a*) is a top view. FIG. 20(*b*) of is a cross-sectional view of the D-D line shown in FIG. 20(*a*) viewed in the direction of the arrows.

FIG. 22(*a*) is a cross-sectional view at the E-E line shown in FIG. 21 viewed in the direction of the arrows, and FIG. 22(*b*) is a cross-sectional view at the F-F line shown in FIG. 21 viewed in the direction of the arrows.

FIG. 23(*a*) is a cross-sectional view at the E-E line shown in FIG. 21 viewed in the direction of the arrows, and FIG. 23(*b*) is a cross-sectional view at the F-F line shown in FIG. 21 viewed in the direction of the arrows.

FIG. 27(*a*) shows a state when a voltage is not applied between the fixed electrode and the movable electrode, and FIG. 27(*b*) shows a state when a voltage is applied.

FIG. 35(*a*) is a top view. FIG. 35(*b*) is a cross-sectional view of the H-H line shown in FIG. 35(*a*) viewed in the direction of the arrows.

FIG. 41(*a*) is a cross-sectional view at the P-P line shown in FIG. 40 viewed in the direction of the arrows, and FIG. 41(*b*) is a cross-sectional view at the Q-Q line shown in FIG. 40 viewed in the direction of the arrows.

FIG. 42(*a*) is a cross-sectional view at the P-P line shown in FIG. 40 viewed in the direction of the arrows, and FIG. 42(*b*) is a cross-sectional view at the Q-Q line shown in FIG. 40 viewed in the direction of the arrows.

DETAILED DESCRIPTION

EMBODIMENT 1

Figure 1:
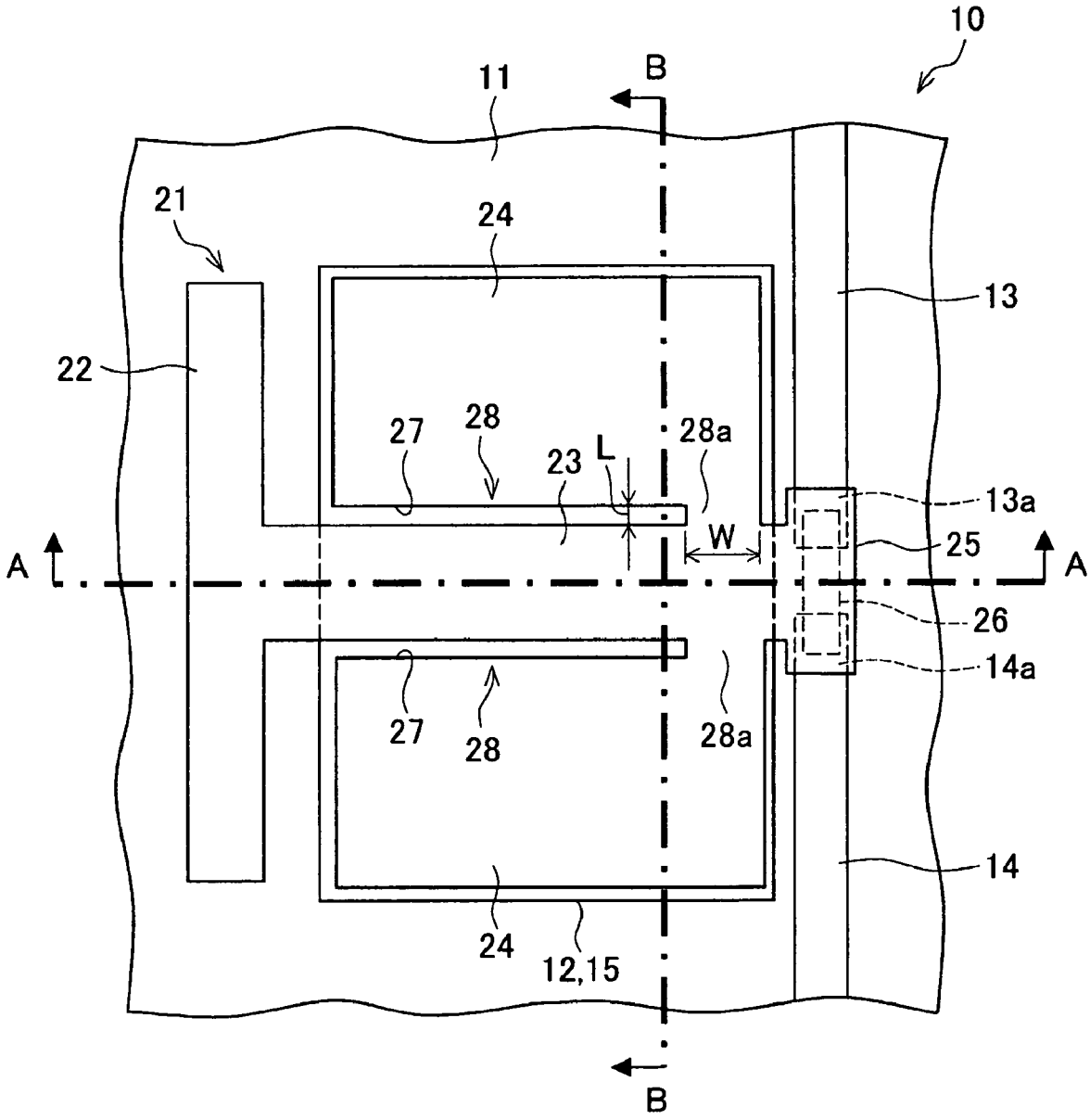
FIG. 1 is a top view showing schematically a micro electromechanical relay that is an embodiment of the present invention.

An exemplary embodiment of the present invention will be explained with reference to FIGS. 1-5. FIG. 1 shows schematically a micro electromechanical relay (micro electromechanical switch) according to the present embodiment. The micro electromechanical relay 10 comprises a base 11 and an actuator 21 that is partially affixed to an upper face of the base at a portion and separated from the base 11 at the other portion. An element that is the same is designated by the same reference. These figures may emphasize specific parts for understanding of the invention. Thus, the various of dimensions of the micro electromechanical relay 10 shown in these figures are not restricted to reflecting the various of dimensions of an actual micro electromechanical relay 10.

The base 11 is formed from a glass substrate such as Pyrex (Trademark). Upon the upper face of the base 11, a pair of signal lines 13 and 14 and a fixed electrode 12 are formed from a conductor such as gold, copper, or aluminum. The pair of signal lines 13 and 14 is disposed linearly along the same line with a slight gap therebetween. A fixed contact 13*a* and a fixed contact 14*a* are formed at the opposing parts of the signal lines 13 and 14, respectively. Further, an insulating film 15 is formed on the fixed electrode 12 for prevention of electrical short circuiting between the fixed electrode 12 and the movable electrode 24.

The actuator 21 is formed from a semiconductor substrate such as silicon. The actuator 21 comprises a supporting portion 22, a beam portion 23, a movable electrode 24, and a movable contact portion 25. The supporting portion 22 is disposed on the face of the base 11, extends upward therefrom, and supports the beam portion 23, the movable electrode 24, and the movable contact portion 25. The beam portion 23 extends from the supporting portion 22 as a cantilever-like beam for elastically supporting the movable contact portion 25 as well as for elastically supporting the movable electrode 24 through a connecting part 28. The movable contact portion 25 is disposed at a distal tip of the beam portion 23, and the movable electrodes 24 are disposed on both sides of the beam portion 23 through the connecting part 28. The connecting part 28, the beam portion 23, and the movable electrode 24 all have the same thickness.

The movable electrode 24 is disposed at a position opposite to the fixed electrode 12 of the base 11. In the present embodiment, by cutting from an end of the movable electrode 24 that is located on a side where the beam portion 23 extends from the supporting portion, a slit 27 is formed in the connecting part 28 between the movable electrode 24 and the beam portion 23. Thus, the movable electrode 24 and the beam portion 23 are connected together at the side of the movable contact portion 25.

The movable contact portion 25 is disposed at a position opposing a region extending from the fixed contact 13*a* to the fixed contact 14*a*. An insulating film (not illustrated) is formed at a lower face of the movable contact portion 25, and a movable contact 26, made from a conductor, is disposed on the insulating film. The movable contact 26 opposes each of the fixed contacts 13*a* and 14*a* and provides mutual electrical contact between the signal lines 13 and 14 by closing the contact between the fixed contacts 13*a* and 14*a*.

The micro electromechanical relay 10 of the present embodiment has a duplex structure such that the movable contact 26 connects and separates the pair of fixed contacts 13*a* and 14*a*. Further, the actuator 21 of the present embodiment supports the movable contact portion 25 from one side and thus is called a "cantilever-type actuator."

Figure 2A:
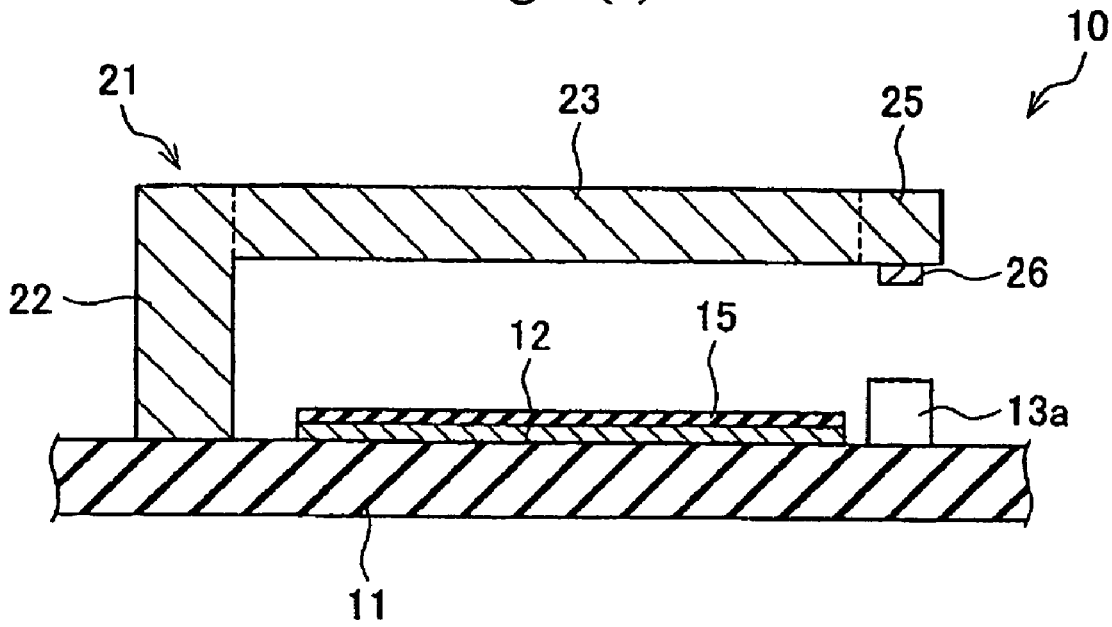
FIG. 2 shows a state of the above-mentioned micro electromechanical relay when a voltage is not applied between the fixed electrode and the movable electrode.
Figure 2B:
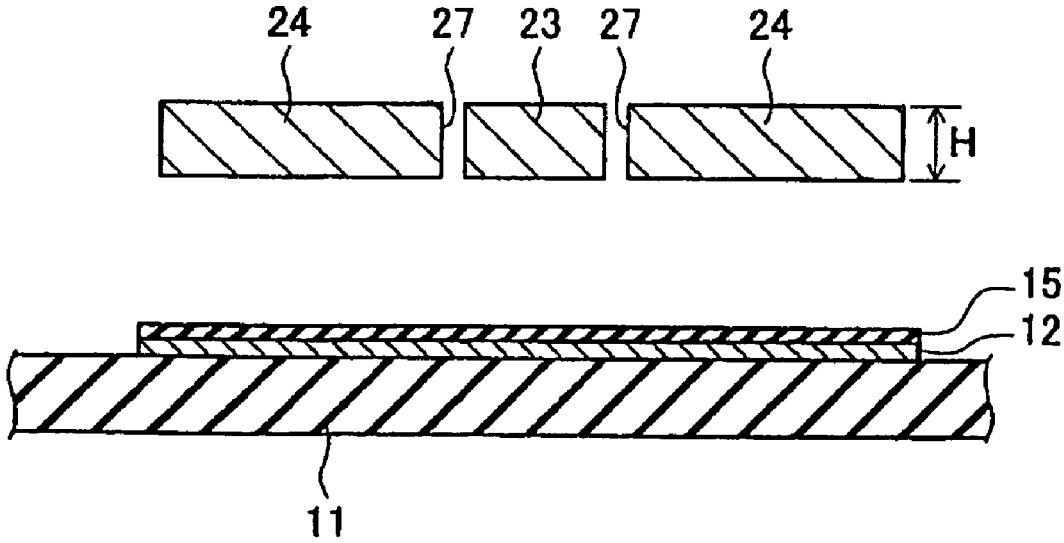

FIGS. 2(*a*) and (*b*) show a state when a voltage is not applied between the fixed electrode 12 and the movable electrode 24. In this case, as shown by the figure, the movable contact 26 is separated from the fixed contact 13*a* and 14*a*, and the signal lines 13 and 14 are electrically mutually separated.

Figure 3A:
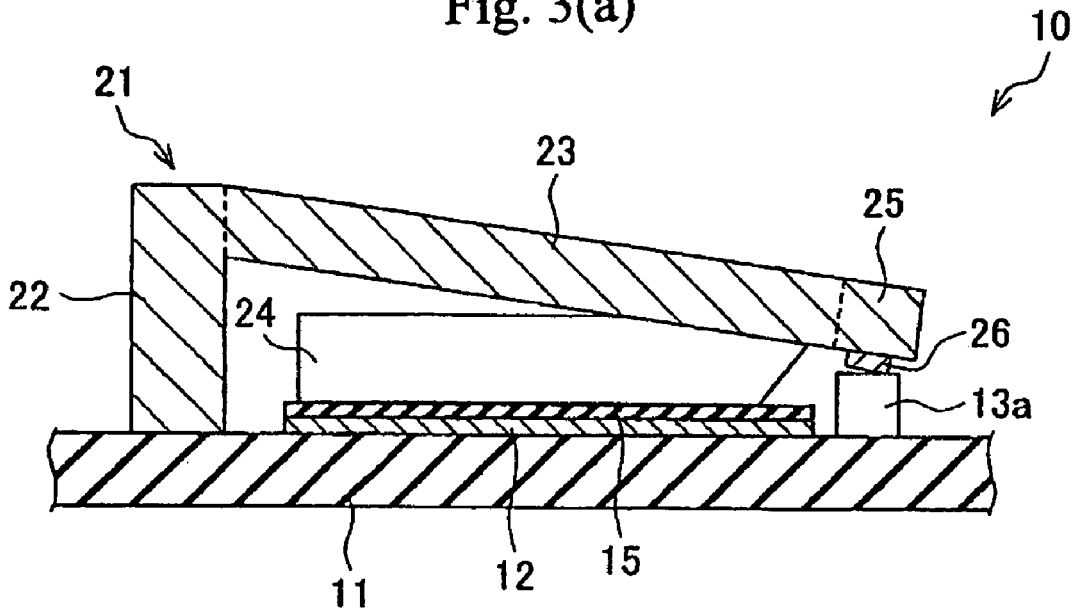
FIG. 3 shows the state of the above-mentioned micro electromechanical relay when a voltage is applied between the fixed electrode and the movable electrode.
Figure 3B:
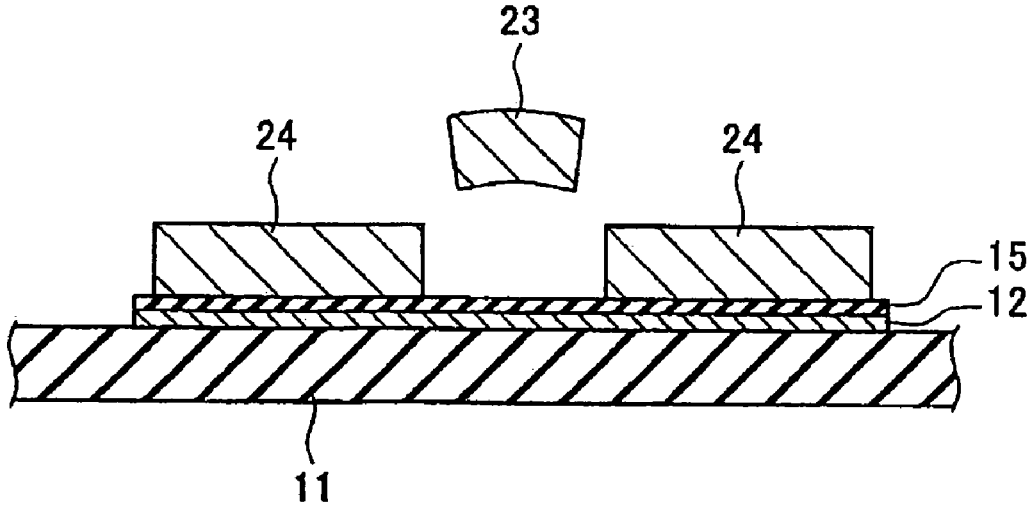

FIGS. 3(*a*) and (*b*) show a state when a voltage is applied between the fixed electrode 12 and the movable electrode 24. In this case, as shown by the figure, the movable electrode 24 is driven by the fixed electrode 12 due to electrostatic attraction caused by the applied voltage. Thus, the movable contact 26 comes into contact with the fixed contact 13*a* and 14*a*, and accordingly the signal lines 13 and 14 are electrically mutually connected.

According to the present embodiment, the beam portion 23 and the movable electrode 24 are connected at the side of the movable contact portion 25, and the slit 27 opens from the side of the supporting portion 22. By way of this configuration, as shown in FIGS. 3(*a*) and (*b*), most parts of the movable electrodes 24 and 24, with the exception of the side of the movable contact 25, come into contact with the fixed electrode 12 through the insulating film 15. The electrostatic attraction between the movable electrode 24 and the fixed electrode 12 is inversely proportional to the square of the distance between the movable electrode 24 and the fixed electrode 12, and therefore this electrostatic attraction becomes quite marked. Thus, even through the elastic constant of the beam portion 23 increases, it is possible to raise the contact force imparted to the movable contact portion 25, and it is possible to stabilize the contact resistance between the movable contact 26 and the fixed contacts 13*a* and 14*a*.

When the voltage between the fixed electrode 12 and the movable electrode 24 disappears, the electrostatic attraction disappears. Thus, the actuator 21, due to restorative force of the beam portion 23 and the movable electrode 24, returns to the original position as shown in FIGS. 2(*a*) and (*b*). According to the present embodiment, as explained previously, it is possible to increase the elastic constant of the beam portion 23. Thus, the restorative force imparted by the beam portion 23 to the movable contact portion 25 can be increased, and it is possible to prevent undesirable contact between the movable contact 26 and the fixed contacts 13*a* and 14*a*.

Various types of characteristics of the movable electrode 24 of the present embodiment were investigated. The amount of displacement of the movable electrode 24 due to application of voltage depends on the elastic constant of the connecting part 28 that interconnects the beam portion 23 and the movable electrode 24. The elastic constant k of the connecting part 28 is shown by the following equation.

$$k \propto W \times H^3 / L^3 \quad (1)$$

where W is a width of an actual connecting portion 28*a* of the connecting part 24 that connects the movable electrode 24 and the beam portion 23. L is a gap length between the movable electrode 24 and the beam portion 23 of the actual connecting portion 28*a*. H is the thickness of the movable electrode 24. The symbols W and L are shown in FIG. 1, and the symbol H is shown in FIG. 2(*b*).

Pull-in voltage is known as an indicator that shows the imparted voltage necessary to sufficiently attract the movable electrode 24 to the fixed electrode 12. The pull-in voltage is a voltage resulting in an inter-electrode distance of movable parallel electrodes plates that is ⅔ rds of the initial distance. When the pull-in voltage is low, the applied voltage required for contacting most of the movable electrode 24 against the fixed electrode 12 becomes low.

The pull-in voltage Vpi is expressed by the following equation.

$$Vpi = ((8 \times k \times d_0^3)/(27 \times \in \times S))^{1/2} \quad (2)$$

where $d_0$ is a distance between the electrodes when a voltage is not applied; ∈ is a dielectric constant between the electrodes; and S is the electrode surface area.

Further, the inter-electrode electrostatic attraction Fele is expressed by the following equation.

$$Fele = (C \times Vs^2)/(2 \times d) \quad (3)$$

where C is electrical capacitance; Vs is an applied voltage; and D is a inter-electrode distance.

Figure 40:
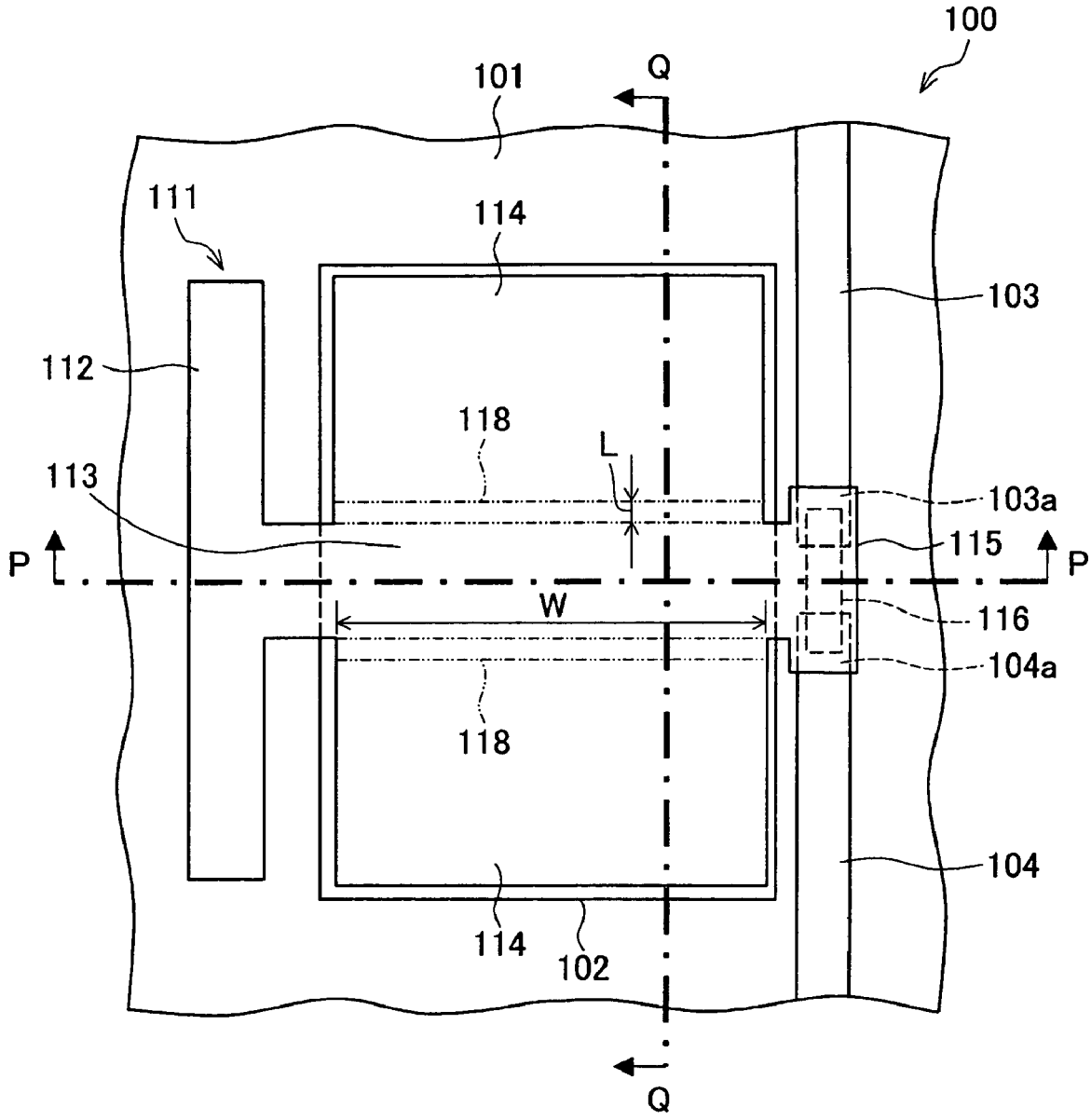
FIG. 40 is a top view showing schematically a conventional micro electromechanical relay.
Figure 41A:
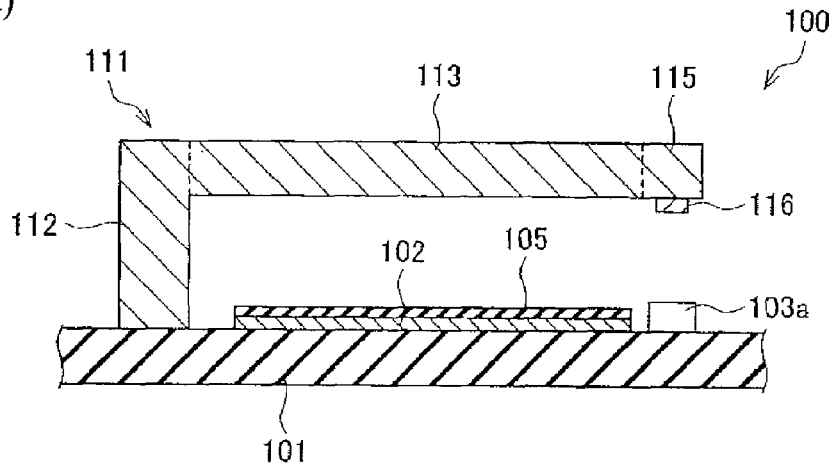
FIG. 41 shows a state of the conventional micro electromechanical relay when a voltage is not applied between the fixed electrode and the movable electrode.
Figure 41B:
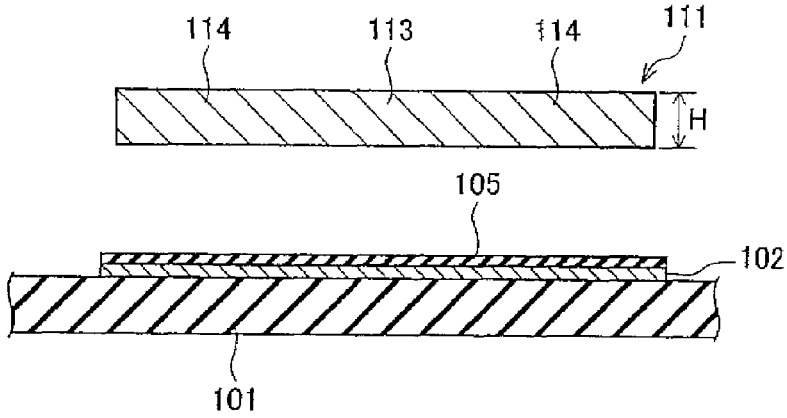
PRIOR ART Fig. 41(b)
Figure 42A:
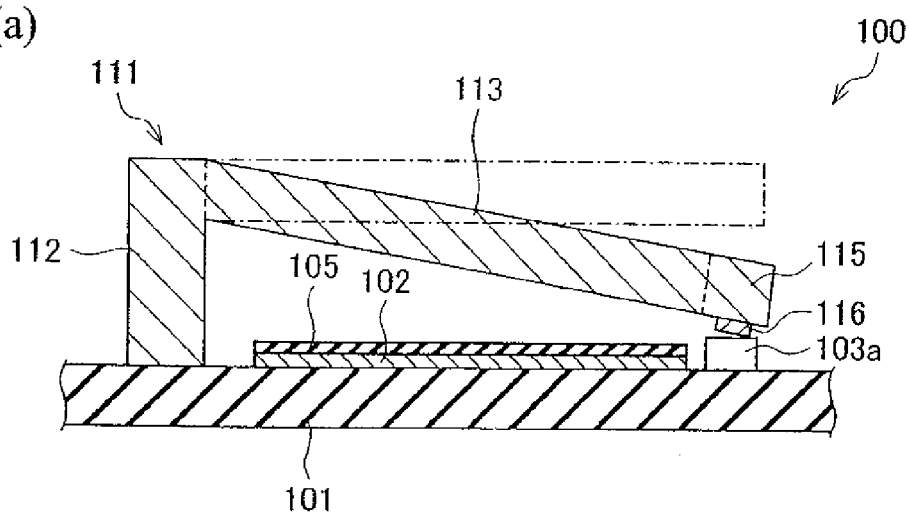
FIG. 42 shows a state of the conventional micro electromechanical relay when a voltage is applied between the fixed electrode and the movable electrode.
Figure 42B:
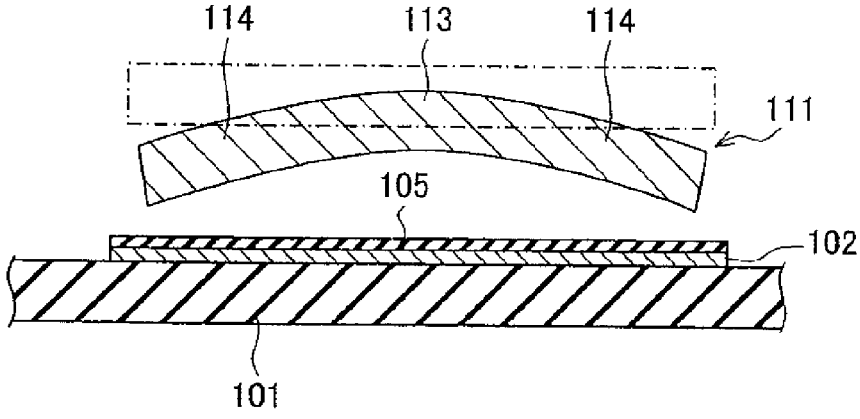
PRIOR ART Fig. 42(b)
Figure 43:
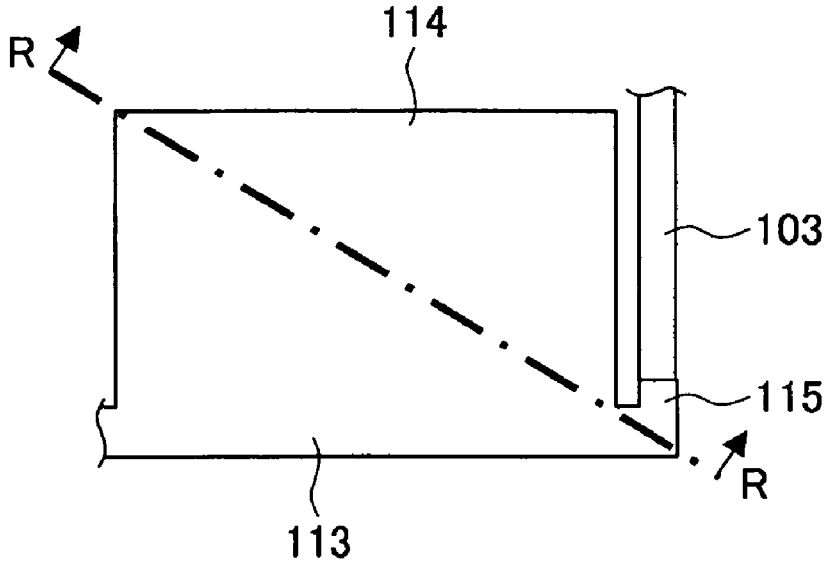
FIG. 43 a top view of the relevant parts of the conventional micro electromechanical relay.
Figure 44A:
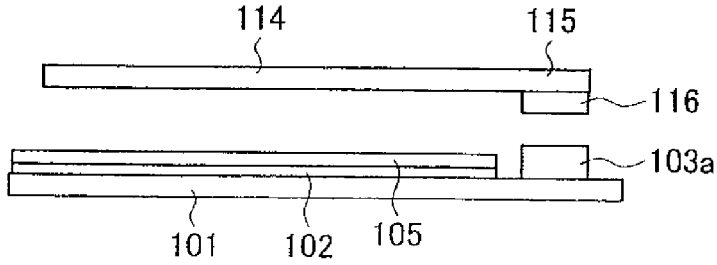
FIGS. 44(*a*)-(*d*) are cross-sectional views at the R-R line shown in FIG. 43, viewed in the direction of the arrows, showing movement of the movable electrode due to electrostatic attraction.
Figure 44B:
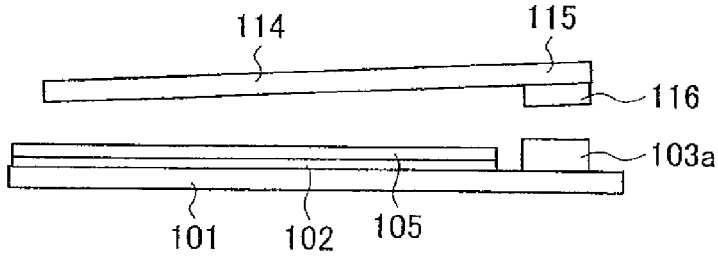
PRIOR ART Fig. 44(b)
Figure 44C:
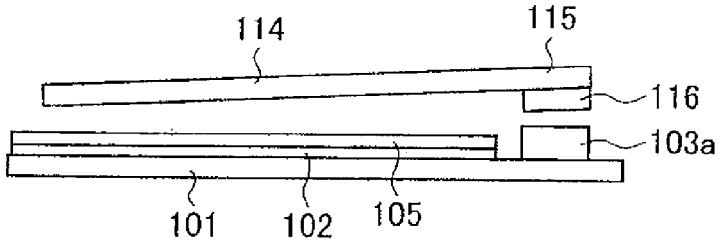
PRIOR ART Fig. 44(c)
Figure 44D:
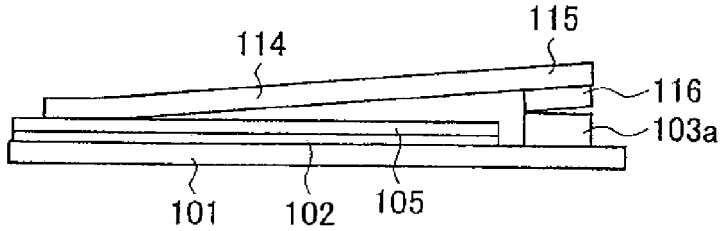
PRIOR ART Fig. 44(d)
Figure 45:
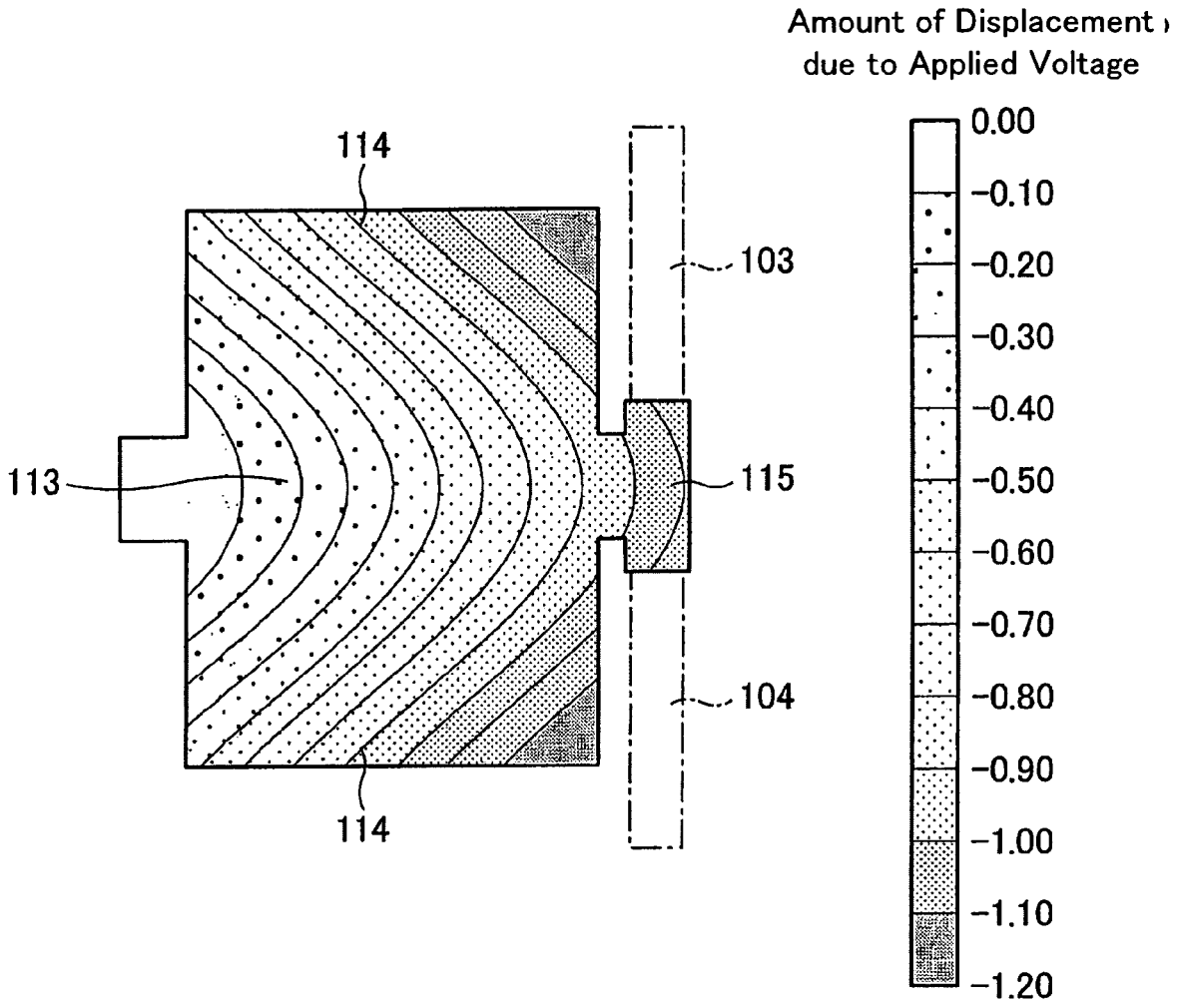
FIG. 45 shows results of a simulation of the amount of displacement of the conventional movable electrode.

Upon comparison of FIGS. 1 and 2(*b*) with FIGS. 40 and 41(*b*), although thickness H and gap length L are equal for the micro electromechanical relay 10 of the present embodiment in comparison to the conventional micro electromechanical relay 101, width W of the actual connecting portion 28*a* is understood to be shorter than the length of the conventional actual connecting portion (i.e., width W of the conventional contacting part 118). Thus, according to the above-mentioned Equation (1, the connecting part 28 of the present embodiment can have a lower elastic constant than that of the conventional connecting part 118. Further, according to the above-mentioned Equation (2), the pull-in voltage can be decreased without increasing the dimensions of the movable electrode 24.

Figure 4:
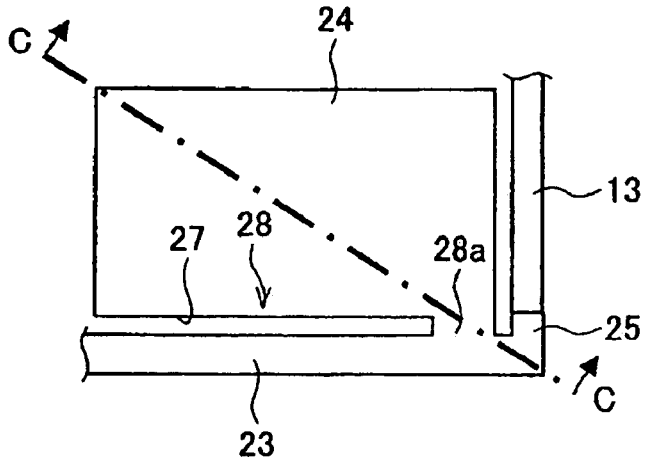
FIG. 4 is a top view of the relevant parts of the micro electromechanical relay.
Figure 5A:
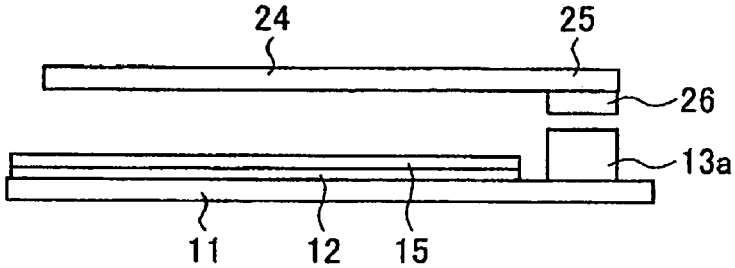
FIG. 5 (*a*)-(*d*) are cross-sectional drawings of the C-C line of FIG. 4, viewed in the direction of the arrows, showing movement of the movable electrode due to electrostatic attraction.
Figure 5B:
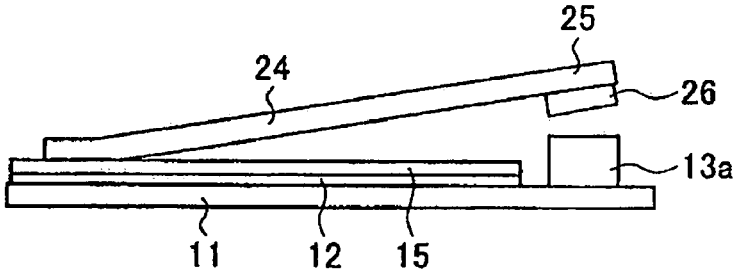
Figure 5C:
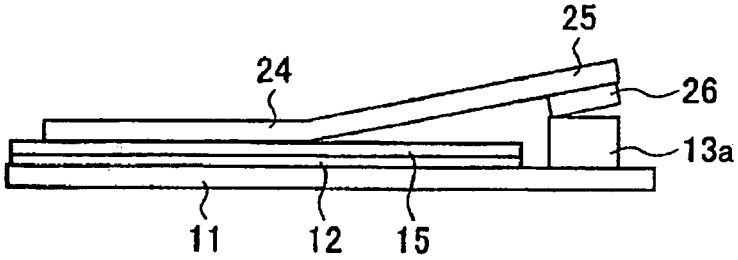
Figure 5D:
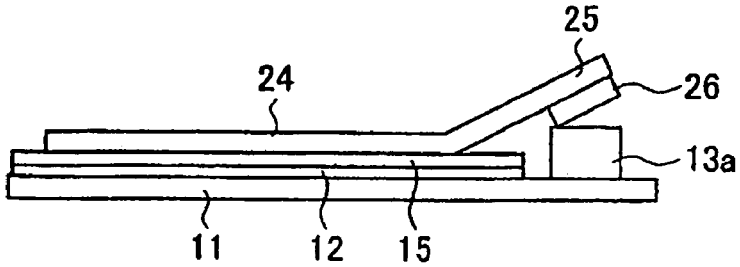

Operation of the movable electrode 24 due to application of voltage will be explained with reference to FIGS. 4 and 5. FIG. 4 shows relevant parts of the micro electromechanical relay 10 of the present embodiment shown in FIG. 1. Further, FIGS. 5(*a*)-(*d*) show cross-sectional views of the C-C line shown in FIG. 4 (i.e., from the movable electrode 24 to the movable contact portion 25) while the movable electrode 24 is moved by electrostatic attraction.

The movable electrode 24 of the present embodiment is driven in the below described manner. Specifically, when a voltage is not applied, the movable electrode 24 is positioned as shown in FIG. 5 (*a*). Then, when a voltage is applied, firstly as shown in FIG. 5(*b*), a corner portion of the movable electrode 24 becomes displaced toward the fixed electrode 12 by electrostatic attraction. At this time, as explained previously, the elastic constant of the connecting part 28 is low, and the amount of deformation is high. Thus, the amount of displacement of the movable electrode 24 is large, and the corner portion comes into contact with the fixed electrode 12 through the insulating film 15.

Due to the large amount of displacement of the movable electrode 24, the distance between the movable electrode 24 and the fixed electrode 12 becomes small, and the electrostatic attraction increases further according to the above-mentioned Equation (3). Thus, as shown in FIG. 5(*c*), the movable electrode 24 and the movable contact portion 25 move toward the base 11. At this time, since the amount of deformation of the connecting part 28 is large, a decrease of the inter-electrode separation becomes greater, and also an increase of the amount of electrostatic attraction becomes greater. For this reason, the amount of displacement of the movable electrode 24 and the movable contact portion 25 is large, half of the movable electrode 24 comes into contact with the fixed electrode 12 through the insulating film 15, and therefore the movable contact 26 comes into contact with the fixed contact 13*a*.

Due to the displacement of the movable electrode 24 toward the base 11, the distance between the movable electrode 24 and the fixed electrode 12 becomes smaller, and electrostatic attraction increases further according to the above-mentioned Equation (3). Thus, as shown in FIG. 5(*d*), the most part of the movable electrode 24 comes into contact with the fixed electrode 12 through the insulating film 15. Since the most part of the movable electrode 24 contacts the fixed electrode 12 through the insulating film 15 in this manner, a sufficiently large electrostatic attraction acts upon the movable electrode 24, and the contact force between the movable contact 26 and the fixed contact 13*a* becomes large, thereby resulting in stabilizing contact resistance.

Thus, it is possible to increase the electrostatic attraction by lowing the elastic constant of the connecting part 28 while maintaining the restorative force unchanged. Accordingly, the contact force can be improved while maintaining a restorative force that is equivalent to the conventional micro electromechanical relay. Further, if the contact force may be equivalent to the conventional micro electromechanical relay, then it is possible to lower the electrostatic attraction, and thus it becomes possible to lower the applied voltage, decrease the dimensions of the movable electrode 24, or the like.

According to the present embodiment, the movable electrodes 24 are disposed on both sides of the movable electrode 24. However, as shown in FIG. 4, it is also permissible to dispose a single movable electrode 24 on only one side of the beam portion 23. However, since the movable contact portion 25 otherwise becomes displaced at a tilt relative to the base 11, the movable electrodes 24 and 24 are preferably disposed on both sides of the beam portion 23.

WORKING EXAMPLE 1

A specific example of the micro electromechanical relay 10 of the present embodiment will be explained while referring to FIGS. 6-9. In this example, a longitudinal direction of the beam portion 23 is referred to as the lengthwise direction, and a narrow direction perpendicular to the lengthwise direction is referred to as the width direction. In the micro electromechanical relay 10 according to the present working example, the base 11 is formed from a glass substrate, and the fixed electrode 12 and the signal lines 13 and 14 are formed from Au. The actuator 21 is formed from a silicon semiconductor substrate, and the movable contact 26 is formed from Au.

In addition, the various dimensions of the micro electromechanical relay 10 are described below. Specifically, a length of the beam portion 23 is 450 μm, and a width is 120 μm. Further, the movable electrode 24 is 410 μm long and 500 μm wide. Furthermore, the contact part 28 has the same length (410 μm) as the movable electrode 24 and has a width of 40 μm. With respect to the connecting part 28, a length of the slit 27 is 310 μm, and a length W of the actual contacting portion 28*a* is 100 μm. Moreover, each thickness H of the beam portion 23, the movable electrode 24, the movable contact portion 25, and the contact part 28 is 21.15 μm. Lastly, a distance between the fixed electrode 12 and the movable electrode 24 when a voltage is not applied is 1.2 μm, and a distance between the fixed contacts 13*a* and 14*a* and the movable contact 26 is 1.0 μm.

Figure 6:
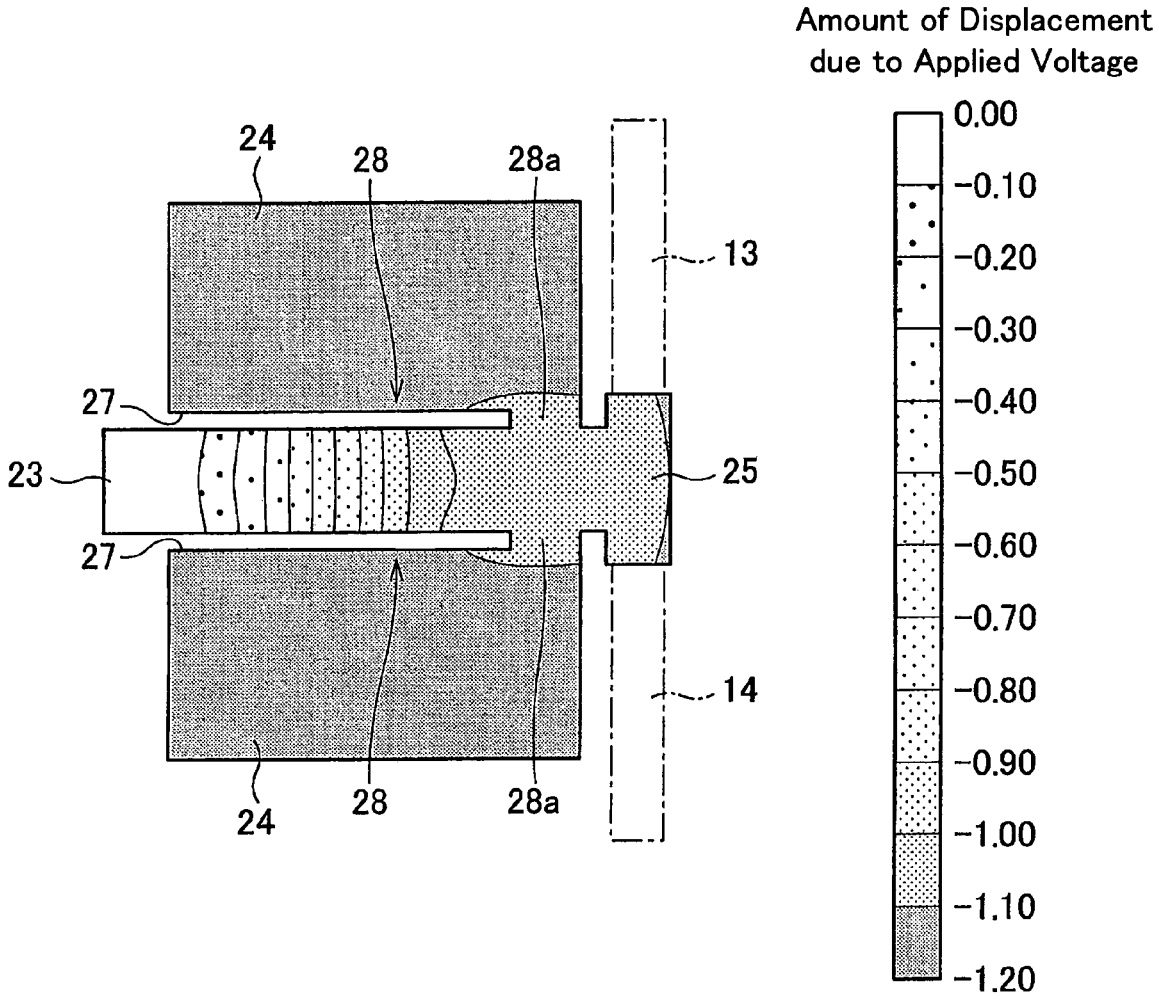
FIG. 6 shows results of a simulation of the amount of displacement of the actuator of the micro electromechanical relay.

FIG. 6 shows results of a simulation of the amount of displacement of the actuator 21 when a voltage of 20V is applied to the micro electromechanical relay 10 of the present working example. When points of equal amount of displacement are interconnected by contour lines, the amount of displacement is indicated by densities of dots within regions bounded by the contour lines and the profile of the movable electrode 24. In other words, the region without dots indicates the region of near zero amount of displacement, and the region of highest density of dots indicates the region of contact between the movable electrode 24 and the fixed electrode 12.

Referring still to FIG. 6, it may be understood that the amount of displacement is large for the movable electrode 24 of the present working example, and the movable electrode 24 contacts nearly all of the fixed electrode 12. Thus, due to the electrostatic attraction between the fixed electrode 12 and the movable electrodes 24, the suppression force of the movable contact 26 against the fixed contacts 13*a* and 14*a* is larger in comparison to the conventional configuration, and thus it may be understood that the contact force increases.

Figure 7:
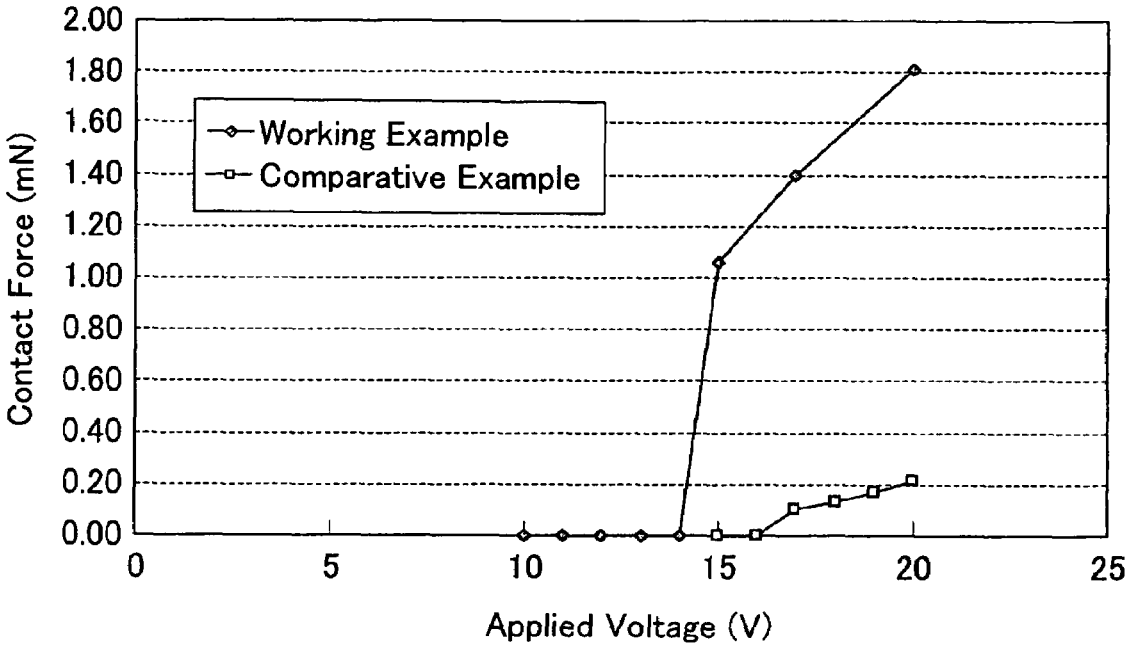
FIG. 7 is a graph showing the relationship between the contact force and the applied voltage for a micro electromechanical relay according to an embodiment of the present invention and a comparative example.
Figure 9:
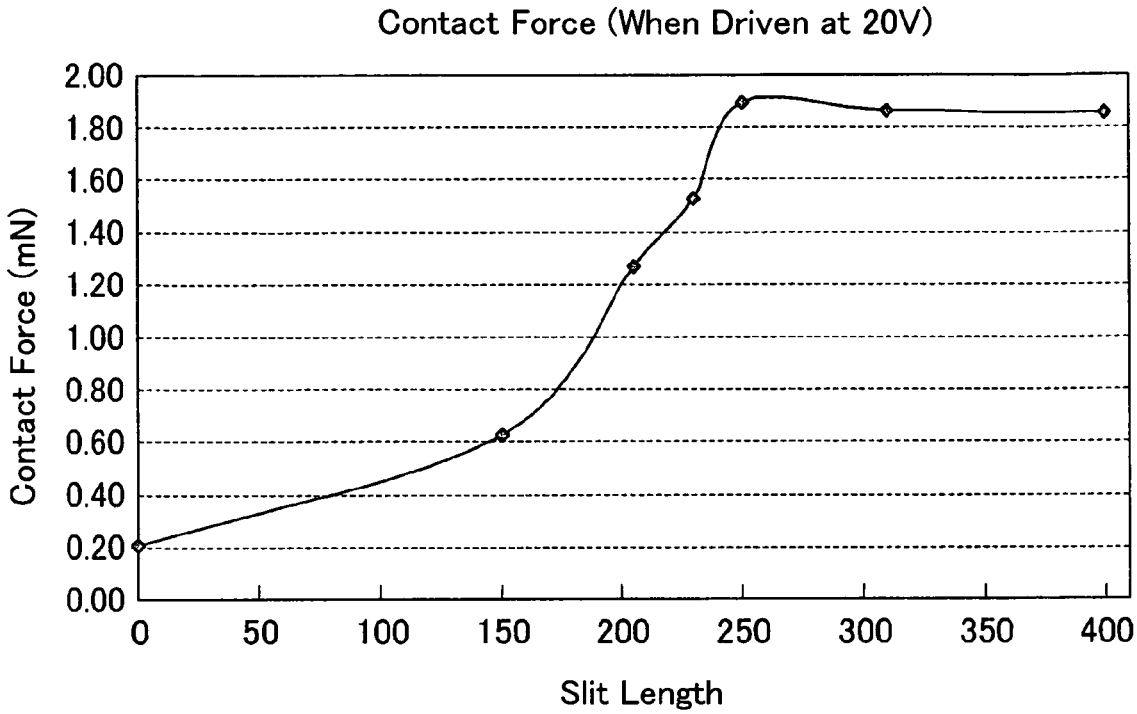
FIG. 9 is a graph showing the relationship between the contact force and slit length for a micro electromechanical relay according to an embodiment of the present invention.

Contact forces of the present working example and the comparative example will be examined in further detail with reference to FIG. 7-9. The comparative example is the conventional micro electromechanical relay 100 shown in FIG. 40, and this micro electromechanical relay 100 has the same above-mentioned dimensions as those of the present working example except for the slit 27. In order to equate the restorative force of the present working example with that of the comparative example, each thickness H of the beam portion 113, the movable electrode 114, and the movable contact 115 is taken to be 19.46 μm. Namely, in order to assure the same degree of restorative force as before for the micro electromechanical relay 10 of the present working example, the thicknesses H of the beam portion 23, the movable electrode 24, the movable contact portion 25, and the connecting part 28 are respectively increased.

FIG. 7 is a graph showing the relationship between contact force and applied voltage for the micro electromechanical relay 10 of the present working example and the micro electromechanical relay 100 of the comparative example. It may be understood by referring to this figure that the micro electromechanical relay 10 of the present working example has markedly improved (9-fold) greater contact force than that of the conventional micro electromechanical relay 100, while restorative force is of the same degree as the conventional one.

The fact that the contact force becomes larger than zero means that the movable contact 26 contacts the fixed contacts 13*a* and 14*a* and that the micro electromechanical relay enters the ON state. Thus, referring to FIG. 7, it may be understood that the present working example enters the ON state at an applied voltage of 15V in comparison to the applied voltage of 17V to enter the ON state for the comparative example. Namely, the micro electromechanical relay 10 of the present working example may be understood to enter the ON state at a lower applied voltage than that of the comparative example.

Referring still to FIG. 7, the contact force of the present working example at an applied voltage of 15V is understood to be higher than the contact force of the comparative example at an applied voltage of 20V. Thus, if it is permissible for the contact force to have the same magnitude as that used previously (0.21 mN), it is then possible to decrease the applied voltage by about 25% from about 20V to about 15V. This is equivalent to nearly halving the electrode surface area. As a result, it becomes possible to achieve a micro electromechanical relay 10 that is smaller than the conventional one and/or that has a lower voltage.

Additionally, as shown in the above mentioned Equation (3), electrostatic attraction is proportional to the electrostatic capacitance. Electrostatic capacitance of the present working example is 29.31 pF, and electrostatic capacitance of the comparative example was 7.16 pF. Thus, the micro electromechanical relay 10 of the present working example, in comparison to the conventional micro electromechanical relay 100, may be understood to have a markedly improved electrostatic attraction for the same applied voltage.

FIGS. 8 and 9 show the relationship between the contact force and length of the slit 27 for the micro electromechanical relay 10 of the present working example in tabular form and graphical form, respectively. Referring to the graph of FIG. 9, it may be understood that there is a dramatic improvement of contact force when the length of the slit 27 is greater than or equal to 150 μm. Thus, the length of the slit 27 is preferably greater than or equal to 150 μm (i.e., greater than or equal to about 37% of the length of the movable electrode 24).

Further, referring to the graph of FIG. 9, it may be understood that contact force becomes maximum when the length of the slit 27 is 250 μm, and contact strength may be understood to be nearly the same for higher values of the length of the slit 27. Thus, the length greater than or equal to 250 μm (i.e., greater than or equal to about 60% of the length of the movable electrode 24) is further preferred for maintenance of stable contact force. Among lengths within this range, and in consideration of variance at the time of manufacture and strength of the actual contacting portion 28*a*, the length of the slit 27 is more preferably 280-370 μm or about 70% to about 90% of the length of the movable electrode 24.

EMBODIMENT 2

Another embodiment of the present invention will be explained with reference to FIG. 10. The micro electromechanical relay 10 according to the present embodiment differs from the micro electromechanical relay 10 shown in FIG. 1 in that a fixed electrode 12 is disposed on either side of the signal lines 13 and 14; and also the supporting portion 22, the beam portion 23, the movable electrode 24, and the connecting part 28 are disposed on either side of the movable contact portion 28; while the composition is similar otherwise. Elements having the same function as those explained for the above-mentioned embodiment are designated by the same references, and further explanation of such elements will be omitted.

Figure 10:
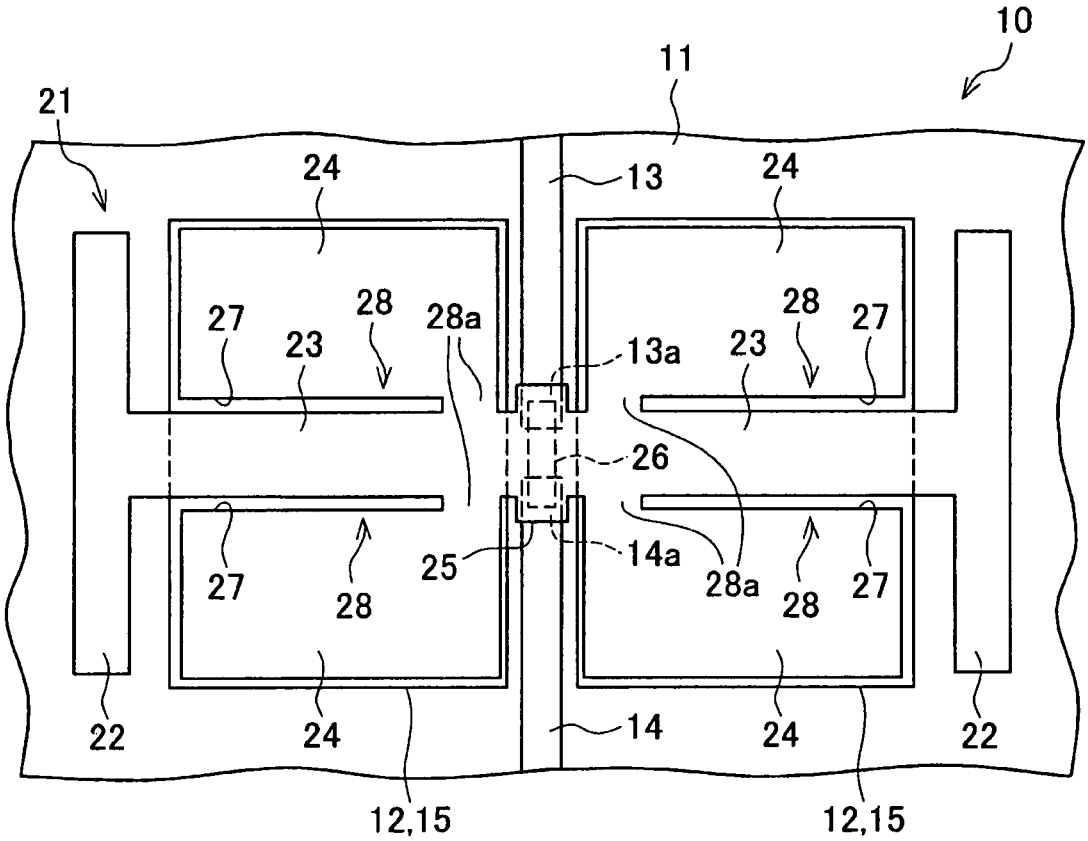
FIG. 10 is a top view showing schematically a micro electromechanical relay according to an embodiment of the present invention.

FIG. 10 shows schematically the micro electromechanical relay 10 of the present embodiment. The illustrated actuator 21 supports the movable contact portion 25 from both sides and thus is called a "double-support type actuator."

The micro electromechanical relay 10 of the present embodiment may have an effect similar to that of the micro electromechanical relay 10 shown in FIG. 1. Further, in comparison to the micro electromechanical relay 10 shown in FIG. 1, although the micro electromechanical relay 10 of the present embodiment requires space for placement of the fixed electrodes 12, etc. at either side of the signal lines 13 and 14, since the movable contact portion 25 can be moved in the vertical direction while maintaining an approximately parallel attitude relative to the base 11, it is possible to stabilize contact between the movable contact 26 and the fixed contacts 13*a* and 14*a*. Moreover, this configuration can suppress unevenly distributed abrasion of the contact parts.

WORKING EXAMPLE 2

An example of the micro electromechanical relay 10 of the present embodiment will be explained with reference to FIG. 11. The micro electromechanical relay 10 of the present working example differs from the micro electromechanical relay 10 shown in FIG. 1 in that a fixed electrode 12 is disposed on either side of the signal lines 13 and 14; and also the supporting portion 22, the beam portion 23, the movable electrode 24, and the connecting part 28 are disposed on either side of the movable contact portion 28; while the various dimensions and materials of the constituent elements are similar.

Figure 11:
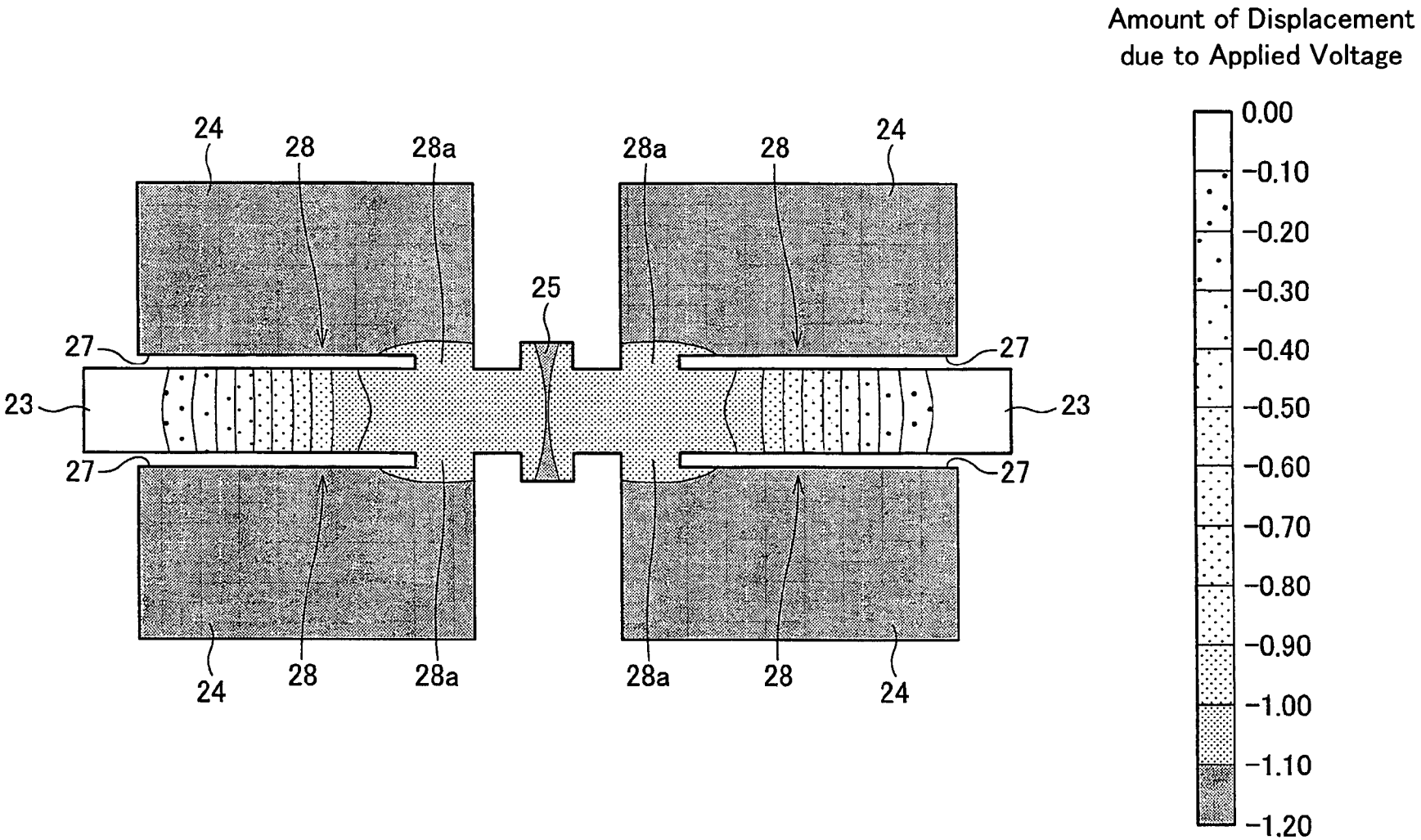
FIG. 11 shows results of a simulation of the amount of displacement of the actuator of the above-mentioned micro electromechanical.

FIG. 11 shows the results of a simulation of the amount of displacement of the movable electrode 24 when a voltage of 20V is applied to the micro electromechanical relay 10 of the present working example. The illustrated contour lines and dots have the same meanings as those of FIG. 6.

It may be understood by referring to FIG. 11 that the amount of displacement of the movable electrode 24 of the present working example is large, and nearly the entire fixed electrode 12 is contacted. It is thus understood, due to the electrostatic attraction between the fixed electrode 12 and the movable electrode 24, that the movable contact 26 presses against the fixed contacts 13*a* and 14*a* with higher force than previously, and the contact force becomes large.

EMBODIMENT 3

Yet another embodiment of the present invention will be explained while referring to FIGS. 12-19. The micro electromechanical relay 10 of the present embodiment differs from the micro electromechanical relay 10 shown in FIG. 1 only in that the actual connecting portion of the connecting part 28 is different, while the composition is otherwise similar. Elements having the same function as those explained for the above mentioned embodiments are designated by the same references, and further explanation of such elements will be omitted.

Figure 12:
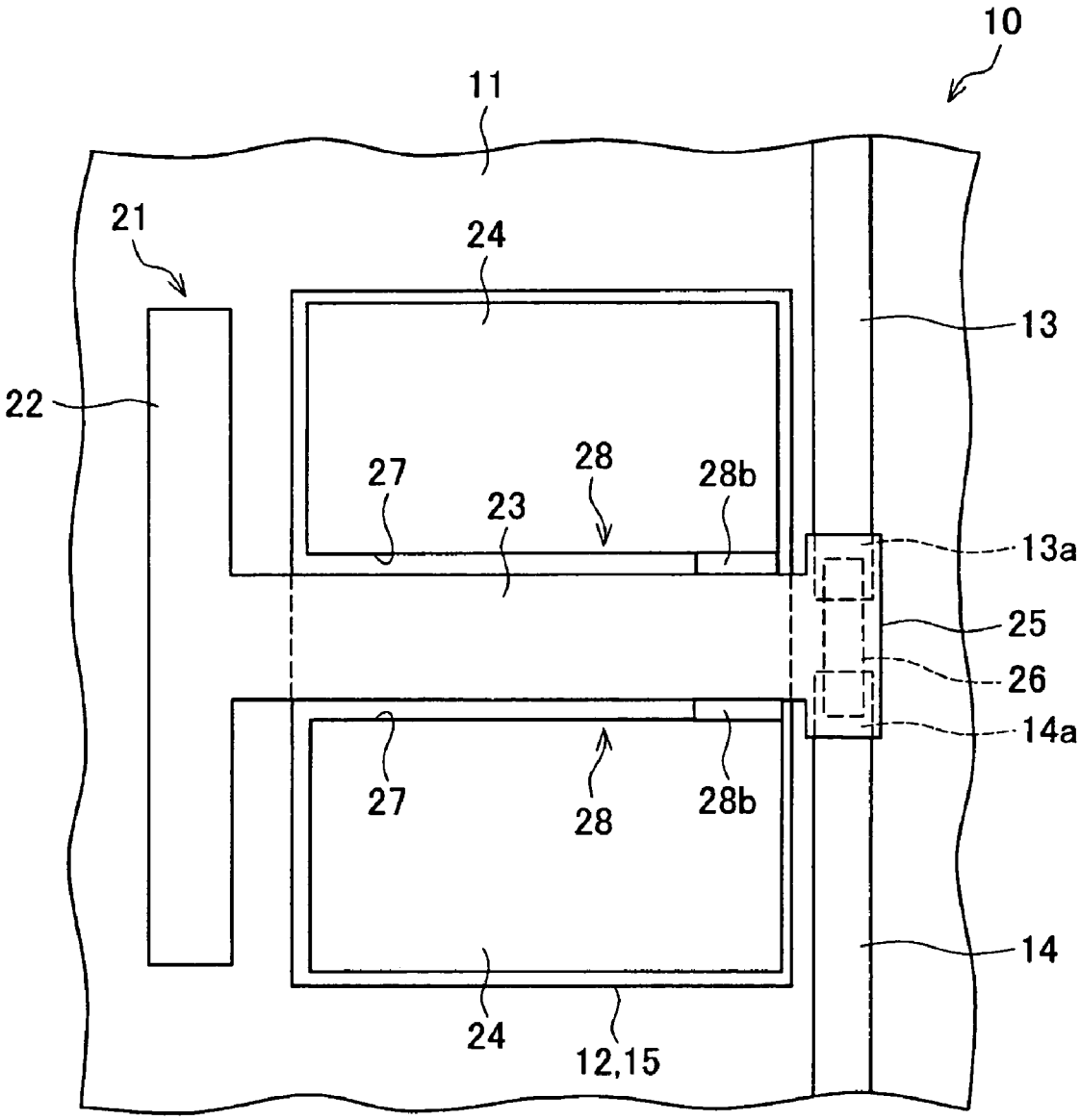
FIG. 12 is a top view showing schematically a micro electromechanical relay according to an embodiment of the present invention.

FIG. 12 shows schematically the micro electromechanical relay 10 of the present embodiment. As shown in this figure, the micro electromechanical relay 10 of the present embodiment differs from the micro electromechanical relay 10 shown in FIG. 1 in that the material and/or structure of the actual connecting portion 28*a* of the connecting part 28 are different; and also the material and/or structure of the beam portion 23 and the movable electrode 24 are different. By way of this it is readily possible to change the width and/or thickness of the actual connecting portion 28*b* according to the material and/or structure of the actual connecting portion 28*b*, and thus this may expand the possibility of design of the actual connecting portion 28*b*.

Example configurations of the actual connecting portion 28*b* that can be cited are: the actual connecting portion 28*b* formed from stacked films, the actual connecting portion 28*b* formed by applying a conductive material and then removing the material down to a single layer, or the like.

A method of manufacture of the micro electromechanical relay 10 of the above-mentioned structure will be explained with reference to FIG. 13-FIG. 15.

Figure 13A:
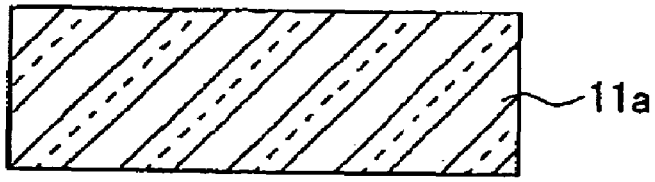
FIGS. 13(*a*) and (*b*) are cross-sectional views showing an example of the manufacturing steps of the base of the micro electromechanical relay.
Figure 13B:
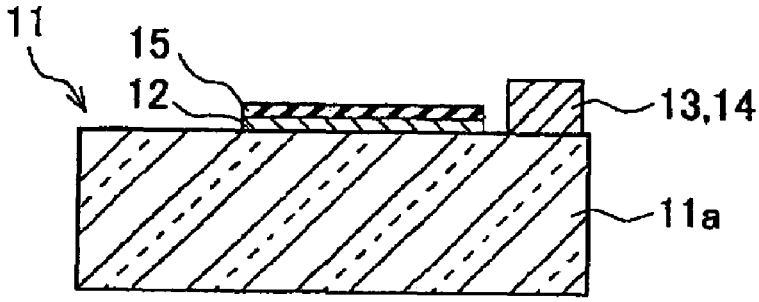

FIGS. 13(*a*) and (*b*) show an example of the manufacturing steps of the base 11. Firstly, as shown in 13(*a*), a glass substrate 11*a* of Pyrex (Trademark) or the like is prepared. Thereafter, as shown in 13(*b*), a metal film is formed on the glass substrate 11*a*, and the fixed electrode 12 and the signal lines 13 and 14 patterns are formed. Simultaneous with this patterning, the respective patterns of other printed lines and pads used for connection may be formed. Thereafter, the base 11 is completed by formation of the insulating film 15 on the fixed electrode 12. If a silicon oxide film of a specific dielectric constant of 3-4 or a silicon nitride film of a specific dielectric constant of 7-8 is used as the insulation film 15, the obtained electrostatic attraction is high, and it is possible to increase contact force.

Figure 14A:
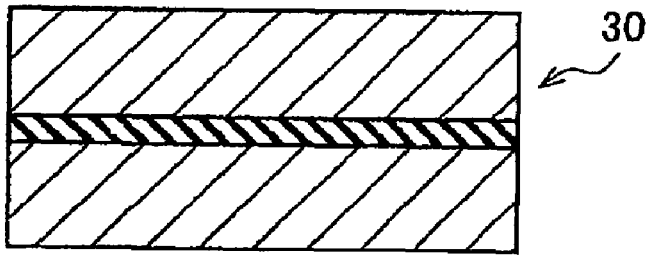
FIGS. 14(*a*) and (*b*) are cross-sectional views showing an example of the manufacturing steps of the actuator of the micro electromechanical relay.
Figure 14B:
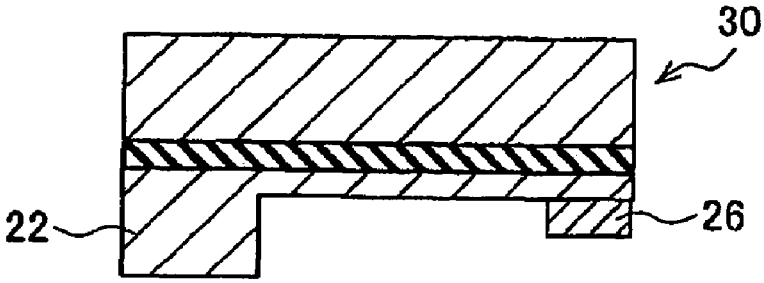

FIGS. 14(*a*) and (*b*) show one example of the manufacturing steps of the actuator 21. Firstly, as shown in FIG. 14 (*a*), a SOI (Silicon On Insulator) wafer 30 is prepared. Thereafter, as shown in FIG. 14(*b*), the silicon oxide film, for example, is etched using TMAH (tetramethyl ammonium hydroxide), while using the silicon oxide film as a mask, to form the supporting portion 22. Thereafter, an insulation film and a metal film are formed, and the pattern of the movable contact 26 is formed.

Figure 15A:
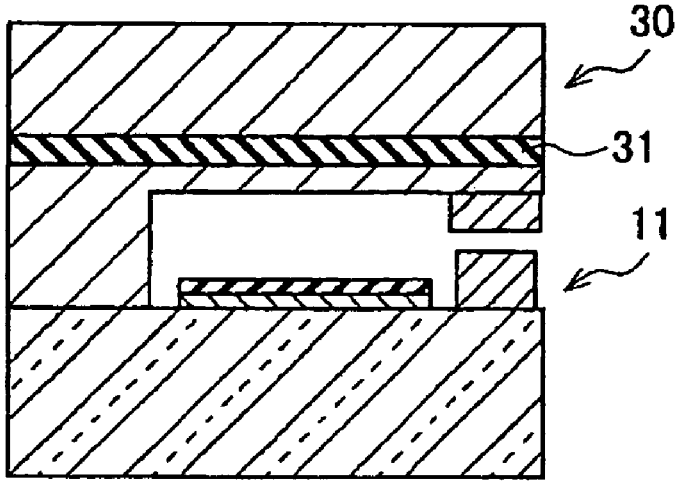
FIGS. 15(*a*)-(*c*) are cross-sectional views showing one example of the connecting steps of the base and the actuator.
Figure 15B:
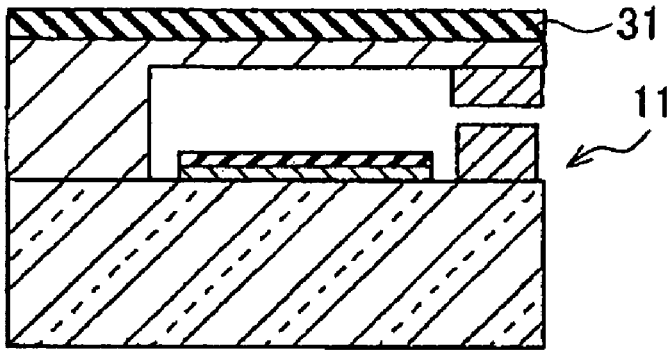
Figure 15C:
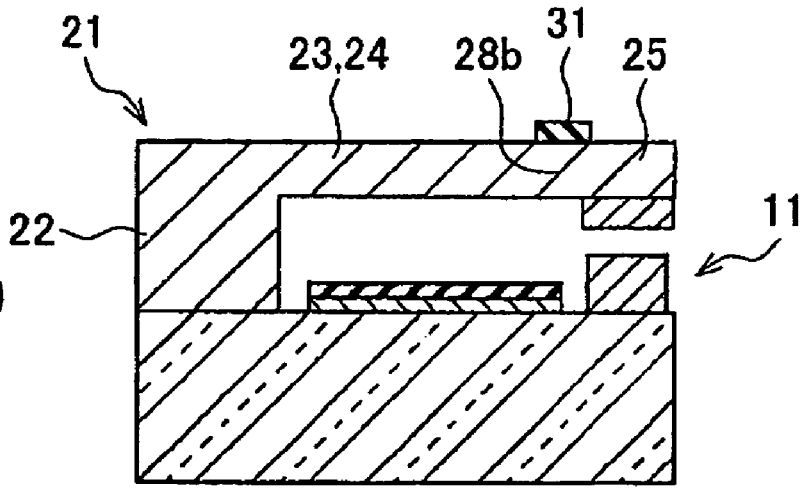

FIGS. 15(*a*)-(*c*) show an example of the steps of bonding the base 11 and the actuator 21. Firstly, as shown in FIG. 15(*a*), the SOI wafer 30 is bonded to the base 11 by the anodic bonding method to form a single unit. Thereafter, as shown in 15(*b*), the upper face of the SOI wafer 30 is etched by an alkali etching solution (e.g., TMAH, KOH, or the like) such that etching occurs down to the silicon oxide ($SiO_2$) film 31. Then, as shown in FIG. 15(*c*), the silicon oxide film 31 in a region other than that corresponding to the actual connecting portion 28*a* of the connecting part 28 is removed by a fluorine type etching solution to expose the beam portion 23, the movable electrode 24, and the movable contact portion 25. Thereafter, dry etching using RIE (Reactive Ion Etching) or the like is carried out to form the slit 27 and the required etched-away parts (not illustrated) to complete the micro electromechanical relay 10.

Thus, the actual connecting portion 28*b* of the connecting part 28 manufactured by the manufacturing method shown in FIGS. 13-15, as shown in FIG. 15(*c*), has a layered structure comprising a compression-stressed film of silicon oxide film 31 formed on the same silicon layer as that of the beam portion 23 and the movable electrode 24.

Another manufacturing method of the micro electromechanical relay 10 of the above mentioned composition will be explained while referring to FIGS. 16 and 17. The manufacturing steps of the base 11 are the same as those shown in FIG. 13, and thus explanation of these steps will be omitted.

Figure 16A:
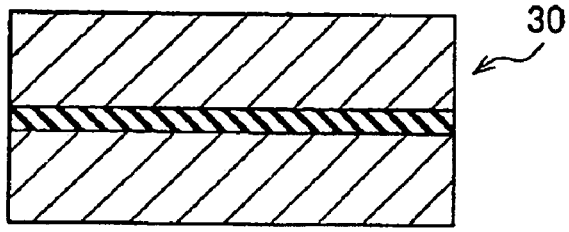
FIGS. 16(*a*)-(*c*) are cross-sectional views showing an example of the manufacturing steps of the actuator.
Figure 16B:
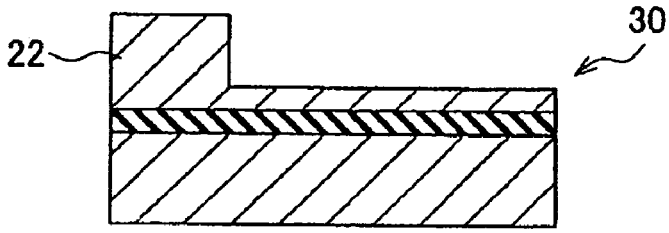
Figure 16C:
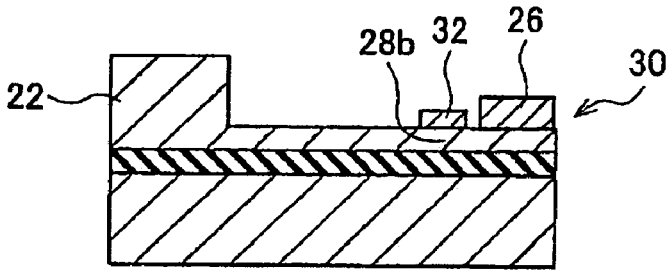

FIGS. 16(*a*)-(*c*) show one example of the manufacturing steps of the actuator 21. Firstly, as shown in FIG. 16(*a*), the SOI wafer 30 is prepared. Thereafter, as shown in FIG. 16(*b*), the silicon oxide film, for example, is etched using TMAH, while using the silicon oxide film as a mask of the upper face of the SOI wafer 30, to form the supporting portion 22. Thereafter, as shown in FIG. 16(*c*), an insulation film and a metal film are formed, and the pattern of the movable contact 26 is formed. Simultaneous with this step, a metal film pattern is formed also in the region corresponding to the actual connecting portion 28*b* of the connecting part 28.

Figure 17A:
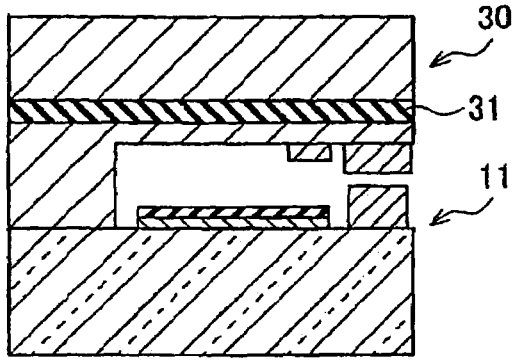
FIG. 17 (*a*) and (*b*) are cross-sectional drawings showing another example of the connecting steps of the above mentioned base and the above mentioned actuator.
Figure 17B:
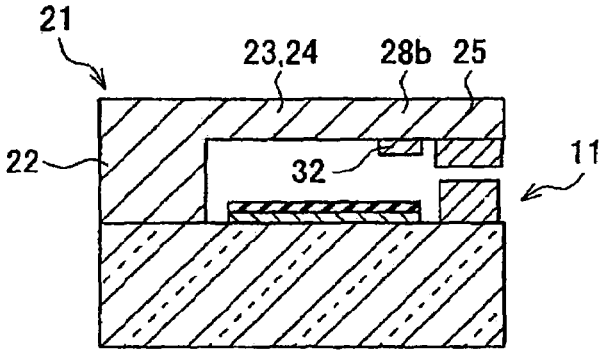

FIGS. 17(*a*) and (*b*) show an example of the steps of bonding the base 11 and the actuator 21. Firstly, as shown in drawing (a) of the same figure, the SOI wafer 30 is bonded to the base 11 by the anodic bonding method to form a single unit. Thereafter, as shown in FIG. 17(*b*), the upper face of the SOI wafer 30 is etched by an alkali etching solution (e.g., TMAH, KOH, or the like) to etch down to the silicon oxide film 31. Also, the silicon oxide film 31 is removed by a fluorine type etching solution to expose the beam portion 23, the movable electrode 24, and the movable contact portion 25. Thereafter, dry etching using RIE or the like is carried out to form the slit 27 and the required etched-away parts (not illustrated) to complete the micro electromechanical relay 10.

Thus, the actual connecting portion 28*b* of the connecting part 28 manufactured by the manufacturing method shown in FIGS. 16 and 17, as shown in FIG. 17(*b*), has a layered structure comprising the silicon layer of both the beam portion 23 and the movable electrode 24 and the metal film 32 formed on the base 11 side.

Another manufacturing method of the micro electromechanical relay 10 of the above mentioned composition will be explained with reference to FIGS. 18 and. 19. The manufacturing steps of the base 11 are the same as those shown in FIG. 13, and thus explanation of these steps will be omitted.

Figure 18A:
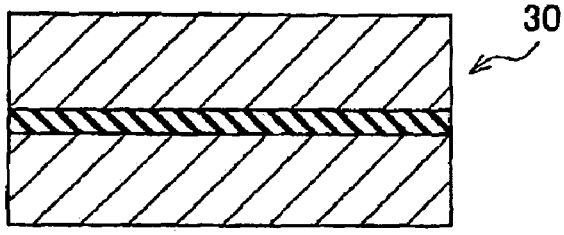
FIGS. 18(*a*)-(*c*) are cross-sectional views showing an example of the manufacturing steps of the actuator.
Figure 18B:
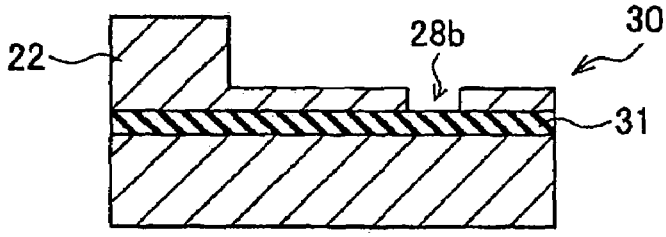
Figure 18C:
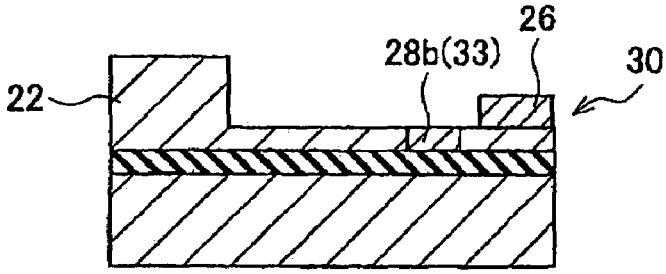

FIGS. 18(*a*)-(*c*) show one example of the manufacturing steps of the actuator 21. Firstly, as shown in FIG. 18(*a*), the SOI wafer 30 is prepared. Thereafter, as shown in FIG. 18(*b*), the silicon oxide film, for example, is etched using TMAH, while using the silicon oxide film as a mask of the upper face of the SOI wafer 30, to form the supporting portion 22. Also, a region corresponding to the actual connecting portion 28*b* of the connecting part 28 is etched to expose the silicon oxide film 31. Thereafter, as shown in FIG. 18(*c*), an insulation film and a metal film are formed, and the pattern of the movable contact 26 is formed. Simultaneous with this step, a metal film 33 pattern is formed also in a recess corresponding to the actual connecting portion 28*b* of the connecting part 28.

Figure 19A:
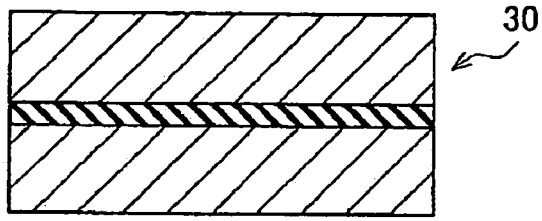
FIG. 19 (*a*)-(*c*) are cross-sectional drawings showing yet another example of the connecting steps of the above mentioned base and the above mentioned actuator.
Figure 19B:
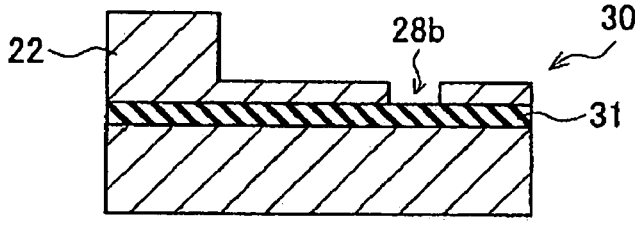
Figure 19C:
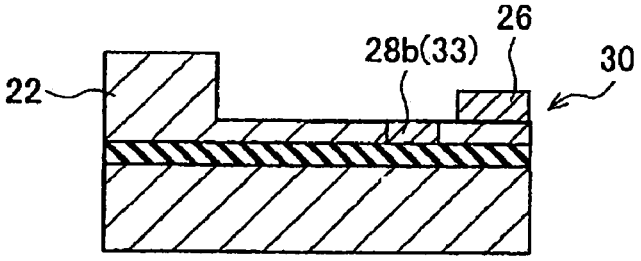

FIGS. 19(*a*) and (*b*) show one example of the steps of bonding the base 11 and the actuator 21. Firstly, as shown in FIG. 19(*a*), the SOI wafer 30 is bonded to the base 11 by the anodic bonding method to form a single unit. Thereafter, as shown in FIG. 19(*b*), the upper face of the SOI wafer 30 is etched by an alkali etching solution (e.g. TMAH, KOH, or the like) to etch down to the silicon oxide film 31. Also, the silicon oxide film 31 is removed by a fluorine type etching solution to expose the beam portion 23, the movable electrode 24, and the movable contact portion 25. Thereafter, dry etching using RIE or the like is carried out to form the slit 27 and the required etched-away parts (not illustrated) to complete the micro electromechanical relay 10.

Thus, the actual connecting portion 28*b* of the connecting part 28 manufactured by the manufacturing method shown in FIGS. 18 and 19, as shown in FIG. 19(*b*), has a single-layer structure formed by the metal film 33 from a different material than that of the beam portion 23 and the movable electrode 24.

EMBODIMENT 4

Another embodiment of the present invention will be explained with reference to FIG. 20. The micro electromechanical relay 10 of the present embodiment differs from the micro electromechanical relay 10 shown in FIG. 1 in that the contact structure is a singleplex structure, while the composition is otherwise similar. Elements having the same function as those explained for the above mentioned embodiments are designated by the same references, and further explanation of such parts will be omitted.

Figure 20A:
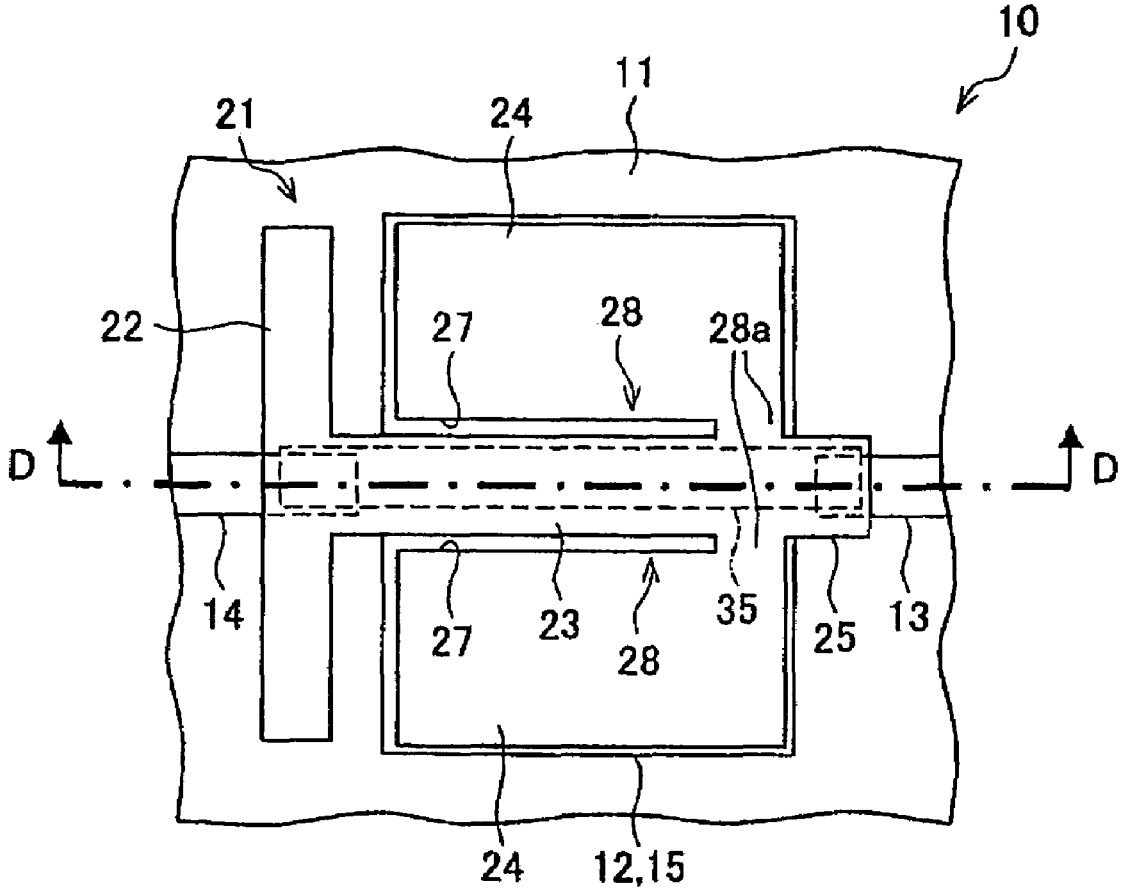
FIG. 20 shows a structure of a micro electromechanical relay according to an embodiment of the present invention.
Figure 20B:
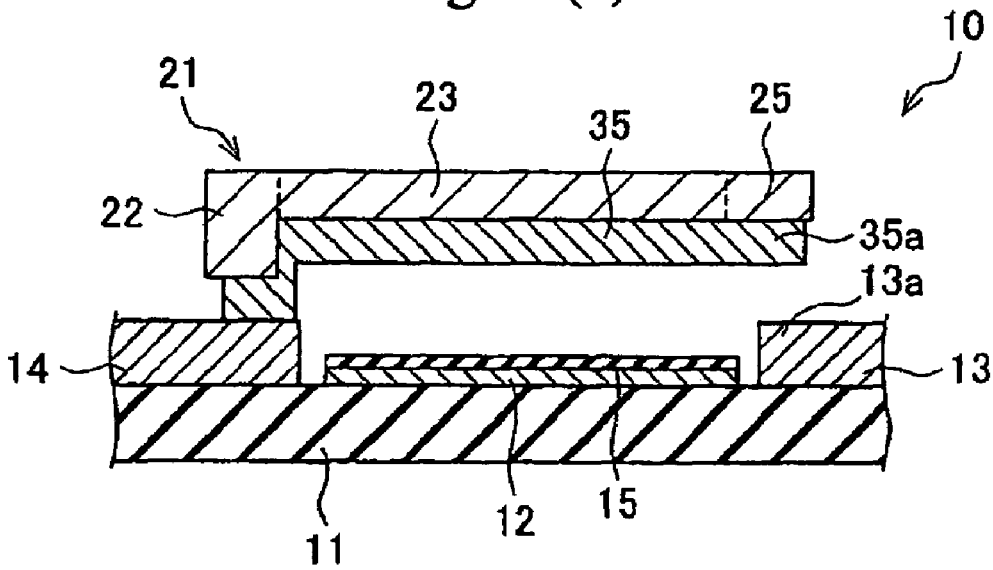

FIG. 20 shows schematically the micro electromechanical relay 10 of the present embodiment. As per this figure, the micro electromechanical relay 10 of the present embodiment differs from the micro electromechanical relay 10 shown in FIG. 1 in that the signals lines 13 and 14 are disposed on the base 11 co-linearly with the beam portion 23 so that the signals lines 13 and 14 are sandwiched between the fixed electrodes 12. The part of the signal line 13 opposite to the signal line 14 serves as the fixed contact 13*a*.

A signal line 35, formed from an electrical conductor through an intermediary insulating film (not illustrated), is formed at a bottom surface of the actuator 21 from the center of the supporting portion 22 along the beam portion 23 to the movable contact portion 25. The signal line 35 is connected electrically to the signal line 14 of the base 11, and the bottom surface part of the movable contact portion 25 (i.e., the part opposite to the fixed contact 13*a* of the signal line 13) serves as a movable contact 35*a*.

When a voltage is applied between the movable electrode 24 and the fixed electrode 12 of the micro electromechanical relay 10 of the above mentioned composition, the movable contact portion 25 moves, and the movable contact 35*a* and the fixed contact 13*a* come into mutual contact. By way of this, the signal lines 13 and 14 become connected together electrically through the signal line 35. The present embodiment has the singleplex structure, wherein the movable contact 35*a* contacts and separates from a single fixed contact 13*a*. The micro electromechanical relay 10 of the present embodiment has improved contact reliability due to a low number of contacts in comparison to the micro electromechanical relay 10 shown in FIG. 1.

EMBODIMENT 5

Another embodiment of the present invention will be explained while referring to FIGS. 21-25. The micro electromechanical relay 10 of the present embodiment differs from the micro electromechanical relay 10 shown in FIG. 1 in that composition of the connecting part 28 is different, while the structure is otherwise similar. Elements having the same function as those explained for the above mentioned embodiments are designated by the same references, and further explanation of such elements will be omitted.

Figure 21:
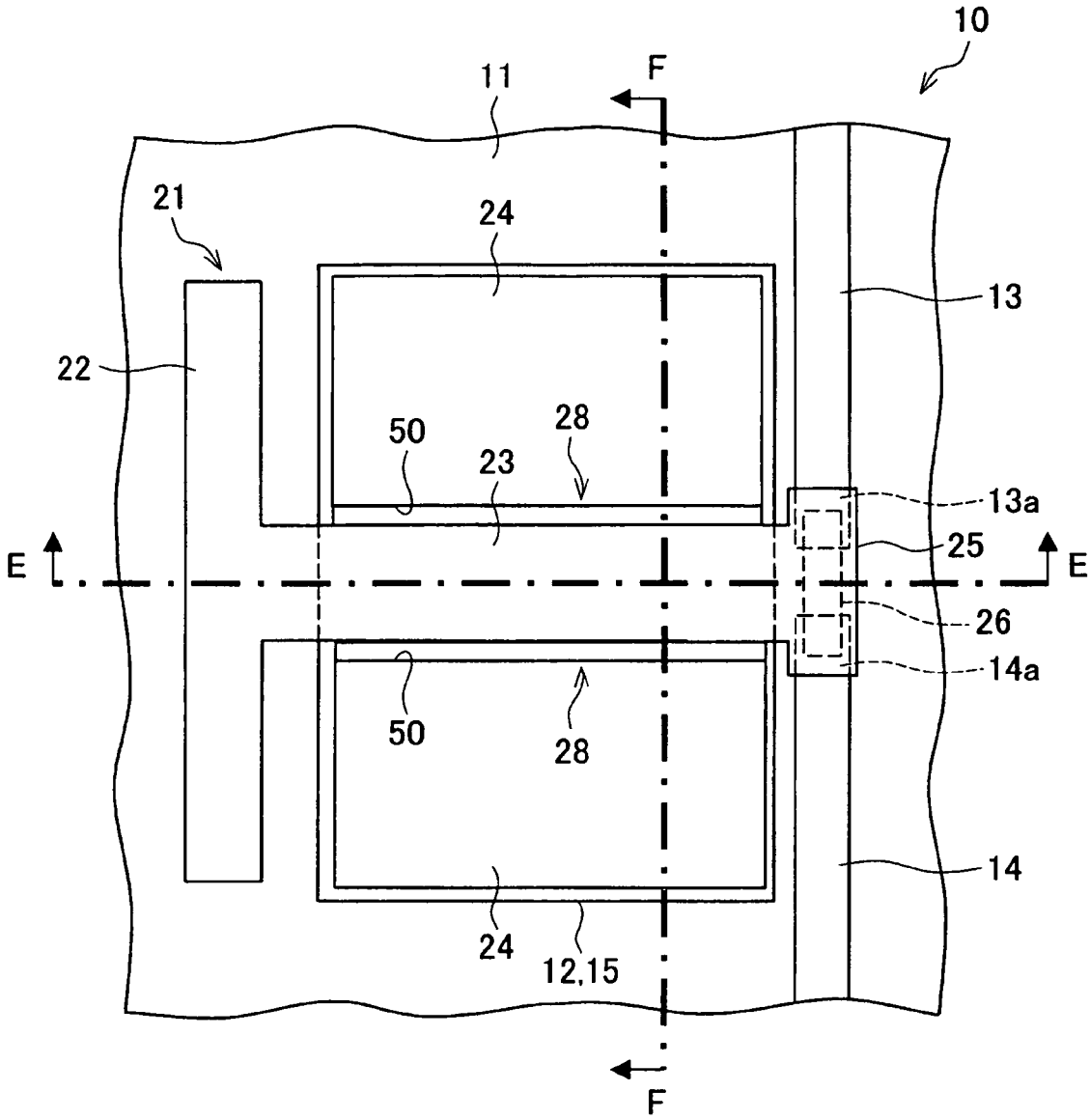
FIG. 21 is a top view schematically showing a micro electromechanical relay according to an embodiment of the present invention.

FIG. 21 shows schematically the micro electromechanical relay 10 of the present embodiment. Referring to FIG. 21, the micro electromechanical relay 10 of the present embodiment differs from the micro electromechanical relay 10 shown in FIG. 1 in that grooves 50 are formed in the connecting part 28 in the interval between the movable electrode 24 and the beam portion 23.

Figure 22A:
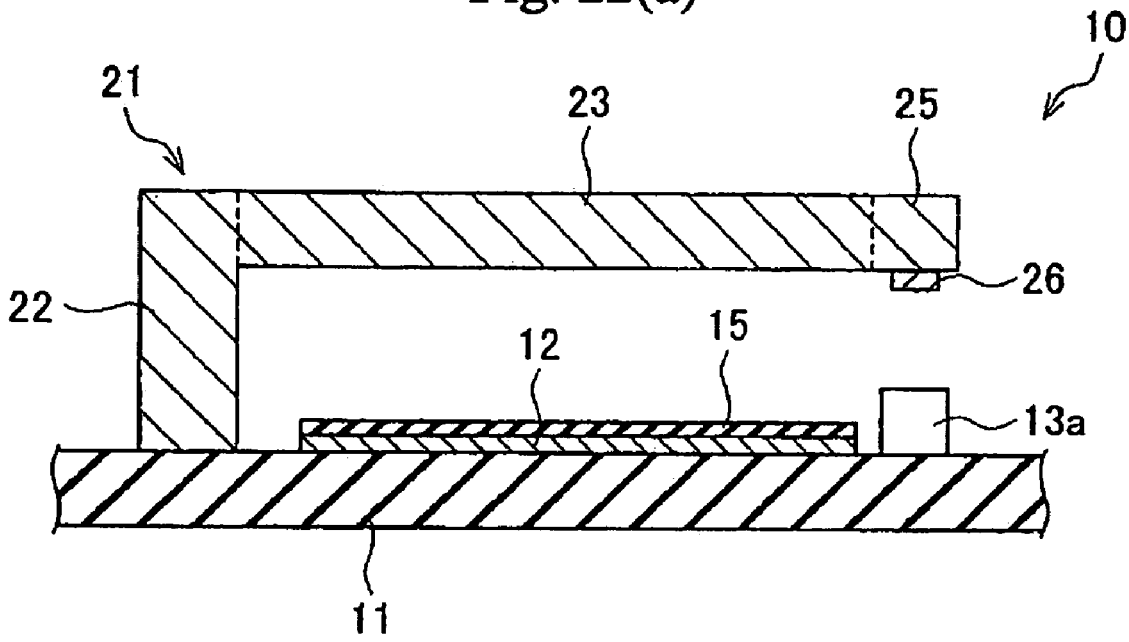
FIG. 22 shows a state of the above-mentioned micro electromechanical relay when a voltage is not applied between the fixed electrode and the movable electrode.
Figure 22B:
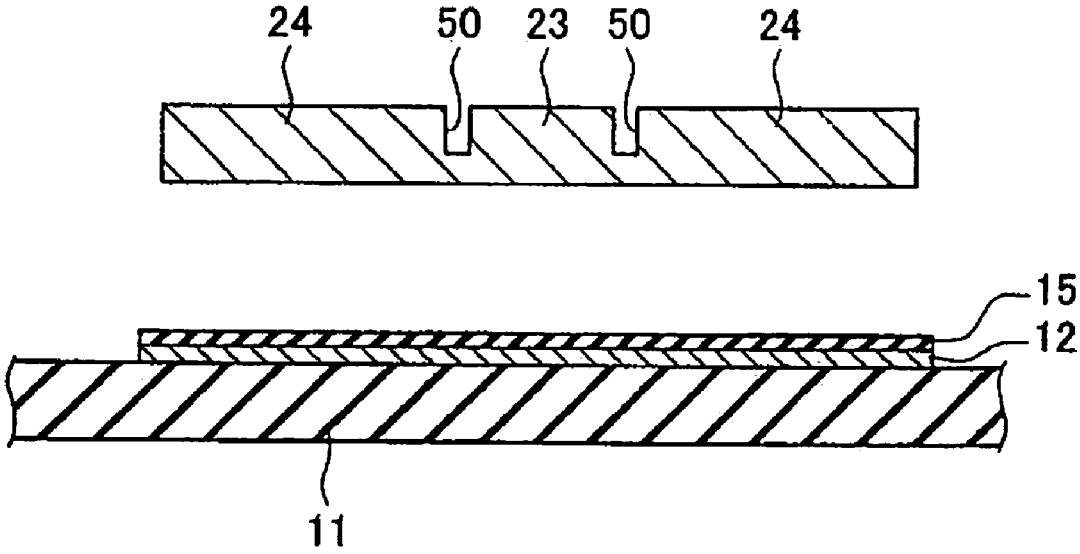

FIGS. 22(*a*) and (*b*) show a state when a voltage is not applied between the fixed electrode 12 and the movable electrode 24. In this case, as shown in these figures, the movable contact 26 is separated from the fixed contacts 13*a* and 14*a*, and the signal line 13 and the signal line 14 are mutually separated electrically.

Figure 23A:
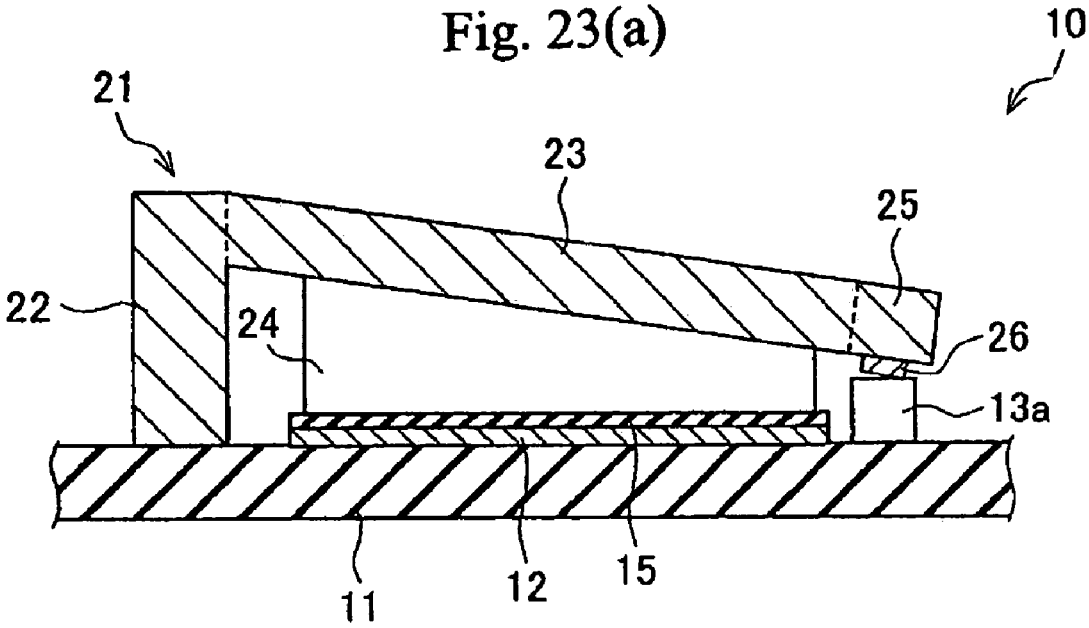
FIG. 23 shows a state of the above-mentioned micro electromechanical relay when a voltage is applied between the fixed electrode and the movable electrode.
Figure 23B:
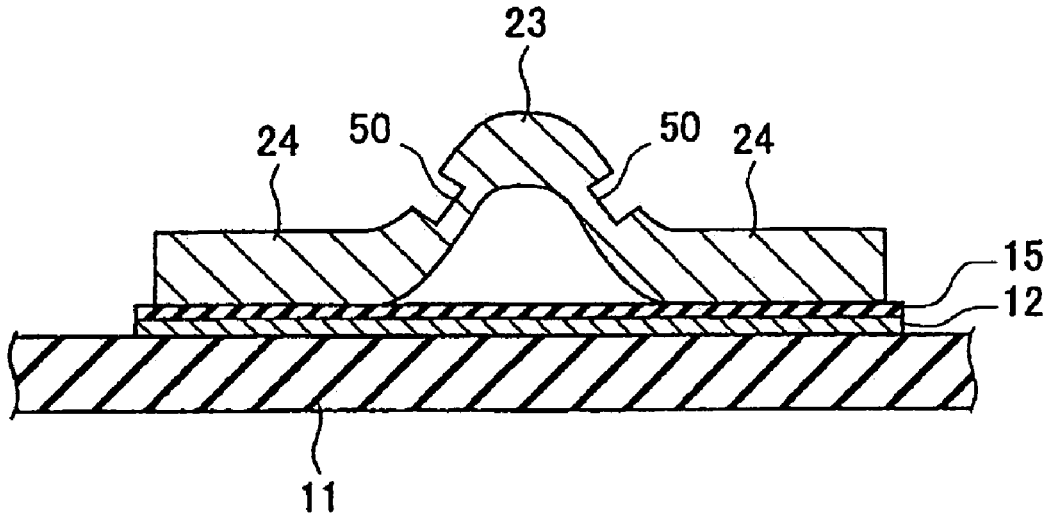

FIGS. 23(*a*) and (*b*) show a state when voltage is applied between the fixed electrode 12 and the movable electrode 24. As shown in these figures, the movable electrode 24 is driven toward the fixed electrode 12 due to electrostatic attraction generated by the above mentioned application of voltage. Thus, the movable contact 26 contacts the fixed contacts 13*a* and 14*a*, and the signal line 13 and the signal line 14 are mutually connected electrically.

According to the present embodiment, grooves 50 are formed in the connecting part 28. Since the groves 50 are thin in comparison to the beam portion 23 and the movable electrode 24, the elastic constant is lower than that of the conventional configuration, and deformation occurs more readily. Thus, as shown in FIGS. 23(*a*) and (*b*), with the exception of the region near the beam portion 23, most parts of the movable electrode 24 contact the fixed electrode 12 through the insulating film 15 due to the increased bending according to the grooves 50. In this case, the electrostatic attraction between the movable electrode 24 and the fixed electrode 12 is inversely proportional to the square of the distance between the movable electrode 24 and the fixed electrode 12. Thus, the electrostatic attraction becomes markedly increased. Accordingly, even though the elastic constant of the beam portion 23 becomes large, it is possible to increase the contact force imparted to the movable contact portion 25, and it is possible to stabilize resistance between the movable contact 26 and the fixed contacts 13*a* and 14*a*.

When the voltage between the fixed electrode 12 and the movable electrode 24 disappears, the electrostatic attraction disappears, and the actuator 21 returns to the original position shown in FIGS. 22(*a*) and (*b*) due to the restorative force of the beam portion 23, the movable electrode 24, and the grooves 50.

Figure 24:
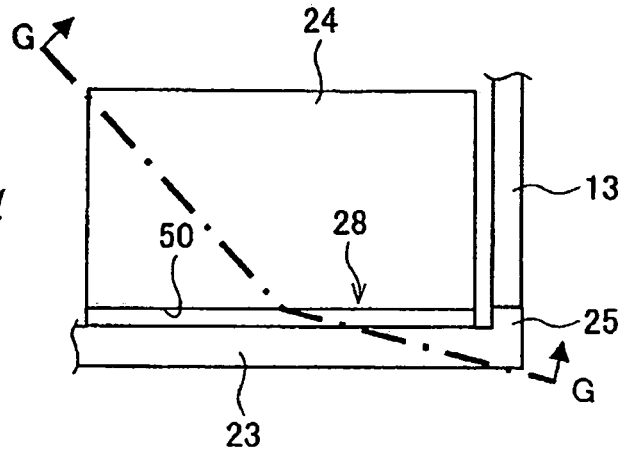
FIG. 24 is a top view of the relevant parts of the above-mentioned micro electromechanical relay.
Figure 25A:
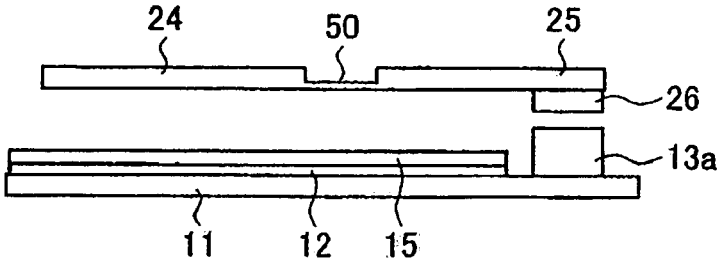
FIGS. 25(*a*)-(*d*) show cross-sectional views of the G-G line shown in FIG. 24, viewed in the direction of the arrows, showing movement of the movable electrode due to electrostatic attraction.
Figure 25B:
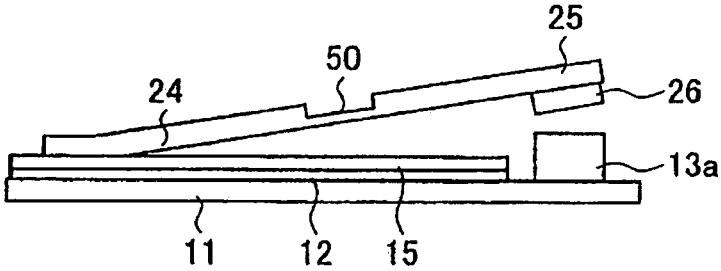
Figure 25C:
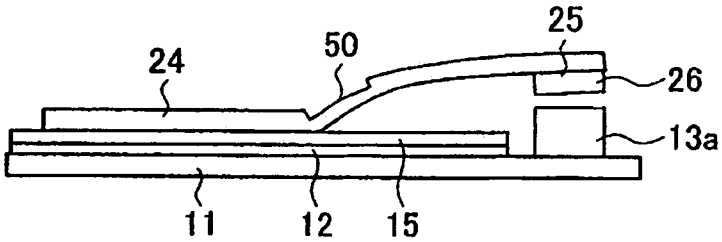
Figure 25D:
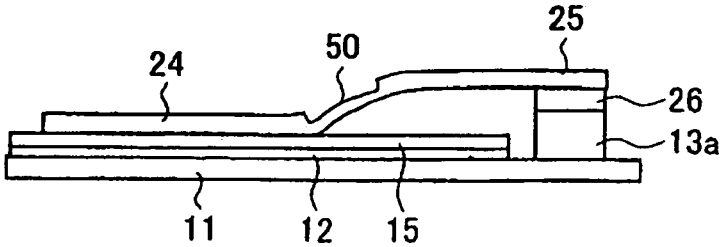

Driving of the movable electrode 24 due to application of voltage will be explained with reference to FIGS. 24 and 25. FIG. 24 shows relevant parts of the micro electromechanical relay 10 of the present embodiment shown in FIG. 21. Further, FIGS. 25(*a*)-(*d*) are cross-sectional drawings of the C-C line shown in FIG. 24 (i.e., from the movable electrode 24 to the movable contact portion 25) showing movement of the movable electrode 24 due to electrostatic attraction.

The movable electrode 24 of the present embodiment operates in the below described manner. Specifically, when a voltage is not applied, the movable electrode 24 is positioned as shown in FIG. 25(*a*). Thereafter, when a voltage is applied, firstly as shown in FIG. 25(*b*), the movable electrode 24 becomes displaced toward the fixed electrode 12 due to electrostatic attraction. At this time, as explained previously, the amount of deformation of the grooves 50 of the present embodiment is high due to the small elastic constant. Thus, the amount of displacement of the movable electrode 24 increases, and the corner portion of the movable electrode 24 contacts the fixed electrode 12 through the insulating film 15.

Since the amount of displacement of the movable electrode 24 is high, the distance between the movable electrode 24 and the fixed electrode 12 becomes small, and the electrostatic attraction increases according to the above-mentioned Equation (3). Thus, as shown in FIG. 25(*c*), the movable electrode 24 and the movable contact portion 25 move toward the base 11. At this time, since the amount of deformation of the grooves 50 of the present embodiment is large, the above-mentioned inter-electrode distance decreases greatly, and increase of electrostatic attraction is greater. Thus, the amount of displacement of the movable electrode 24 and the movable contact portion 25 is large. Also, half of the movable electrode 24 comes into contact with the fixed electrode through the insulating film 15, and therefore the movable contact 26 comes into contact with the fixed contact 13*a*.

Due to movement of the movable electrode 24 toward the base 11, the distance between the movable electrode 24 and the fixed electrode 12 becomes small, and the electrostatic attraction increases further according to the above-mentioned Equation (3). Thus, as shown in FIG. 25(*d*), the movable electrode 24 and the movable contact portion 25 move further toward the base 11. Due to this movement, since the major part of the movable electrode 24 contacts the fixed electrode 12 through the insulating film 15, resulting in a marked increase of the electrostatic attraction acting on the movable electrode 24. Accordingly, the contact force between the movable contact 26 and the fixed contact 13*a* becomes large, and thereby contact resistance is stabilized.

Thus, it is possible to increase the electrostatic attraction by decreasing the elastic constant of the connecting part 28 while maintaining the restorative force unchanged. Further, it is possible to improve the contact force while maintaining restorative force equivalent to that used previously. If the contact force may be equivalent to that used previously, then it is possible to lower the electrostatic attraction, and thus it becomes possible to lower the applied voltage, decrease the dimensions of the movable electrode 24, or the like.

According to the present embodiment, the movable electrodes 24 are disposed of either side of the beam portion 23. However, as shown in FIG. 24, it is also possible to dispose the movable electrode 24 only at one side of the beam portion 23. However, the movable electrodes 24 and 24 are preferably disposed at either side of the beam portion 23 in order to move the movable contact portion 25 without tilt with respect to the base 11.

EMBODIMENT 6

Another embodiment of the present invention will be explained with reference to FIG. 26. The micro electromechanical relay 10 of the present embodiment differs from the micro electromechanical relay 10 shown in FIG. 21 in that the fixed electrodes 12 are disposed on either side of the signal lines 13 and 14, and the supporting portion 22, the beam portion 23, the movable electrode 24, and the connecting part 28 are disposed on either side of the movable contact 25; whereas the composition is otherwise similar. Elements having the same function as those explained for the above mentioned embodiments are designated by the same references, and further explanation of such elements will be omitted.

Figure 26:
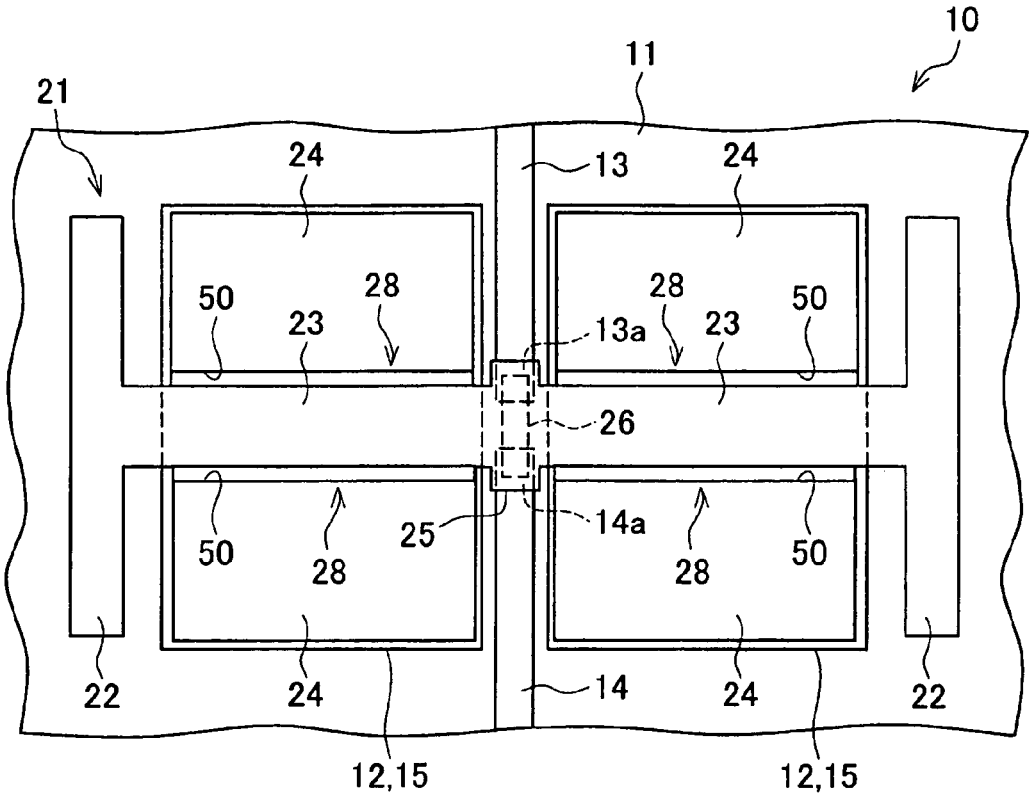
FIG. 26 is a top view of the relevant parts of a micro electromechanical relay according to an embodiment of the present invention.

FIG. 26 shows schematically the micro electromechanical relay 10 of the present embodiment. The illustrated actuator 21 is a double-support type actuator that supports the movable contact portion 25 from both sides.

The micro electromechanical relay 10 of the present embodiment may have a similar useful effect as that of the micro electromechanical relay 10 shown in FIG. 21. Furthe, the micro electromechanical relay 10 of the present embodiment differs from the micro electromechanical relay 10 shown in FIG. 21 in that although space is required for placement of the fixed electrode 12, etc. on either side of the signal lines 13 and 14, the movable contact portion 25 can be moved vertically while maintaining a roughly parallel attitude relative to the base 11. It is thus possible to stabilize contact between the movable contact 26 and the fixed contacts 13*a* and 14*b*. Moreover, it is possible to suppress unevenly distributed abrasion of the contact parts.

EMBODIMENT 7

Another embodiment of the present invention will be explained with reference to FIGS. 27-34. The micro electromechanical relay 10 of the present embodiment differs from the micro electromechanical relay 10 shown in FIG. 21 in that a structure of the connecting parts is different, whereas the remaining structure is otherwise similar. Elements having the same function as those explained for the above mentioned embodiments are designated by the same references, and further explanation of such elements will be omitted.

Figure 27A:
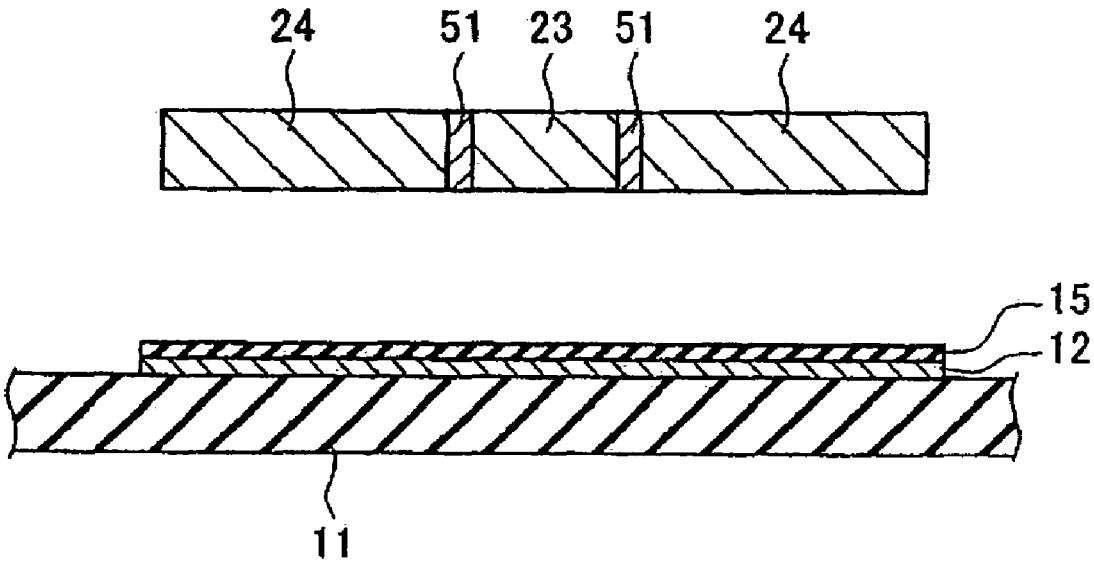
FIG. 27 is a cross-sectional view showing a structure of a micro electromechanical relay according to an embodiment of the present invention.
Figure 27B:
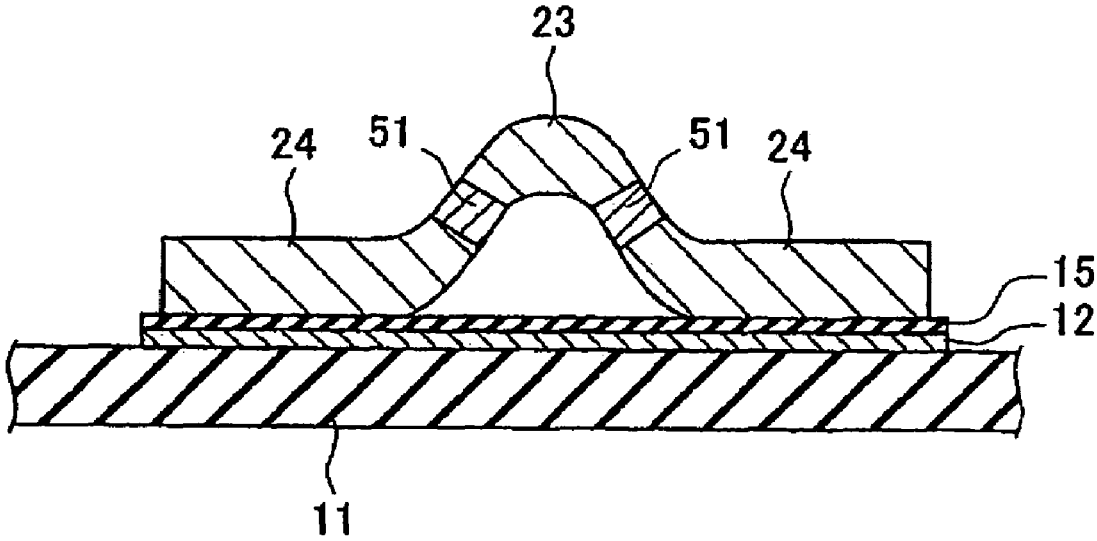

FIGS. 27(*a*) and (*b*) show a structure of the micro electromechanical relay 10 of the present working embodiment. As shown in these figure, the micro electromechanical relay 10 of the present embodiment differs from the micro electromechanical relay 10 shown in FIG. 21 in that the connecting part 51 connecting the beam portion 23 and the movable electrode 24 comprises a conductor or semiconductor that has a smaller elastic constant than the conventional connecting part that the beam portion 23 or the movable electrode 24 would extend. By way of this, the width or thickness of the connecting part 51 can be readily changed according to the material and/or structure of the connecting part 51. This may expand the possibility of design of the connecting part 51. As an example of structure of the connecting part, the connecting part 51 may be formed from stacked films. Alternatively, the connecting part 51 may be formed by applying a conductive material and then removing the material down to a single layer.

A method for manufacture of the micro electromechanical relay 10 of the above mentioned composition will be explained while referring to FIGS. 28-30.

Figure 28A:
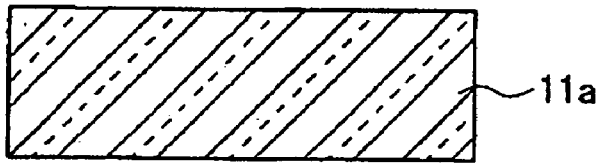
FIGS. 28(*a*) and (*b*) are cross-sectional views showing an example of the manufacturing steps of the base of the above-mentioned micro electromechanical relay.
Figure 28B:
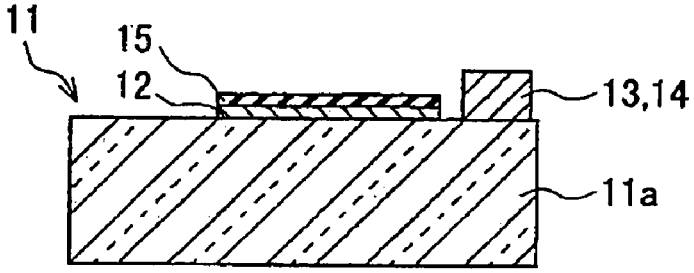

FIGS. 28(*a*) and (*b*) show one example of the manufacturing steps of the base 11. Firstly, as shown in FIG. 28(*a*), a glass substrate 11*a* of Pyrex (Trademark) or the like is prepared. Thereafter, as shown in FIG. 28(*b*), a metal film is formed on the glass substrate 11*a*, and the fixed electrode 12 and the signal lines 13 and 14 patterns are formed. Simultaneous with this patterning, the respective patterns of other printed lines and pads used for connection may be formed. Thereafter, the base 11 is completed by formation of the insulating film 15 on the fixed electrode 12. If a silicon oxide film of a specific dielectric constant of 3-4 or a silicon nitride film of a specific dielectric constant of 7-8 is used as the insulation film 15, the obtained electrostatic attraction is high, and it is possible to increase contact force.

Figure 29A:
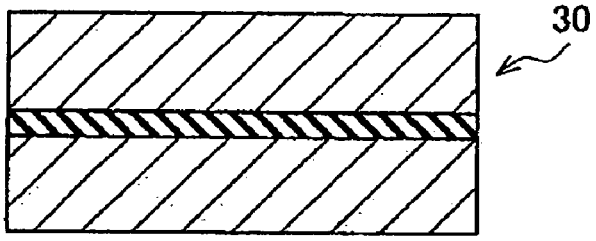
FIGS. 29(*a*)-(*c*) are cross-sectional views showing an example of the manufacturing steps of the actuator of the above-mentioned micro electromechanical relay.
Figure 29B:
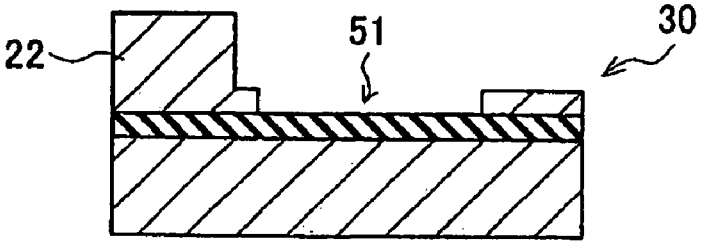
Figure 29C:
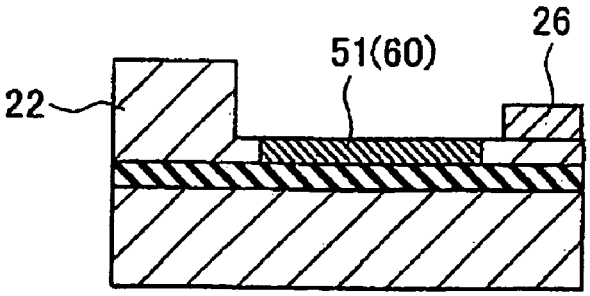

FIGS. 29(*a*)-(*c*) show one example of the manufacturing steps of the actuator 21. Firstly, as shown in FIG. 29(*a*), the SOI wafer 30 is prepared. Thereafter as shown in FIG. 29(*b*), the silicon oxide film, for example, is etched using TMAH, while using the silicon oxide film as a mask, to form the supporting portion 22. Further, etching is carried out in the region corresponding to the connecting part 51, and the silicon oxide film 31 is exposed. Thereafter, as shown in FIG. 29(*c*), an insulation film and a metal film are formed, and the pattern of the movable contact 26 is formed. Simultaneous with this patterning step, the pattern of a metal film 60 is also formed in a region corresponding to the connecting part 51.

Figure 30A:
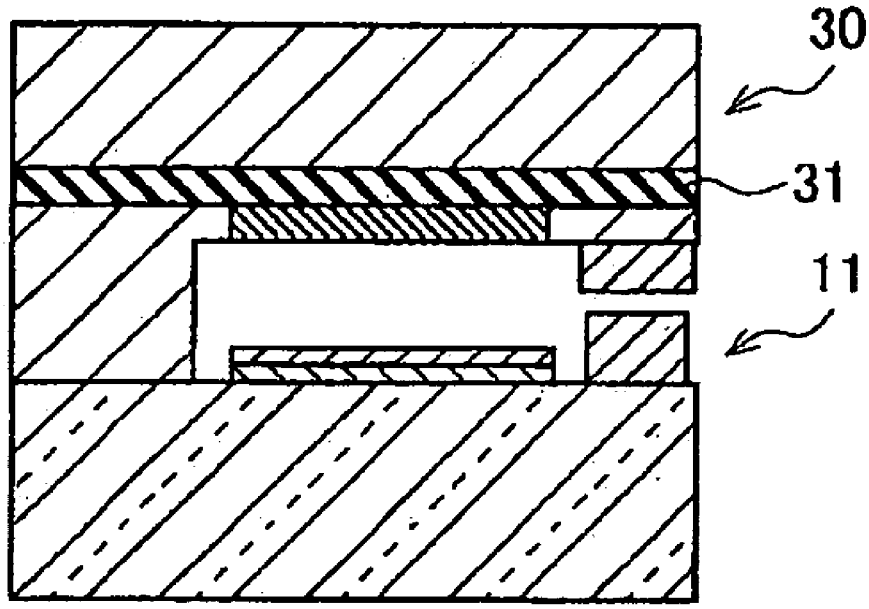
FIGS. 30(*a*) and (*b*) are cross-sectional views showing an example of the connecting steps of the base and the actuator.
Figure 30B:
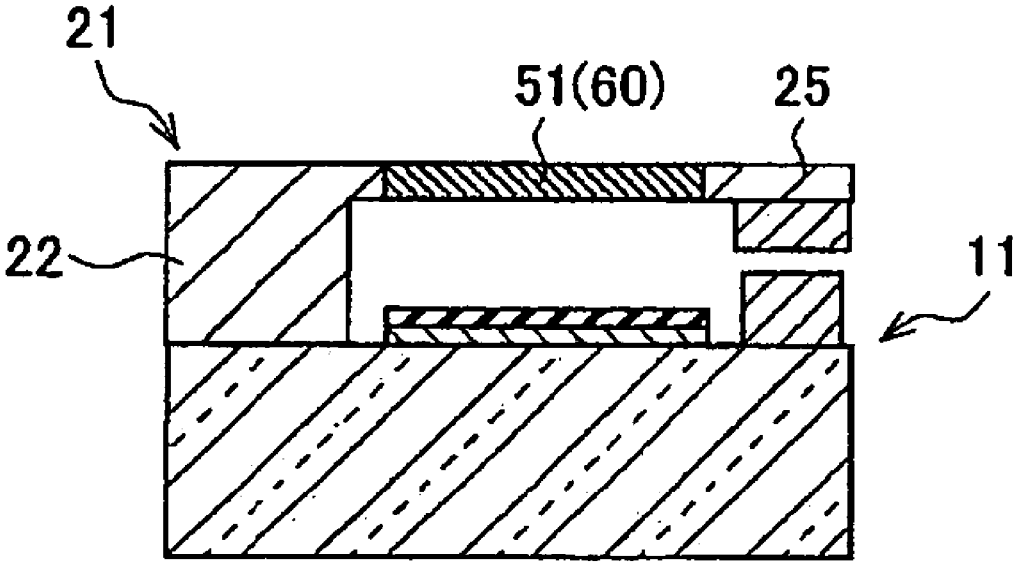

FIGS. 30(*a*) and (*b*) show one example of manufacturing steps of the base 11 and the actuator 21. Firstly, as shown in FIG. 30(*a*), the SOI wafer 30 is bonded to the base 11 by the anodic bonding method to form a single unit. Thereafter, as shown in FIG. 30(*b*), the upper face of the SOI wafer 30 is etched by an alkali etching solution (e.g., TMAH, KOH, or the like) such that etching occurs down to the silicon oxide ($SiO_2$) film 31, and further etching using a fluoride type etching solution removes the silicon oxide film 31 to expose the beam portion 23, the movable electrode 24, the movable contact portion 25, and the connecting part 51. Thereafter, dry etching using RIE or the like is carried out to form the required etched-away parts (not illustrated) to complete the micro electromechanical relay 10.

Thus, the connecting part 51 manufactured by the manufacturing method shown in FIGS. 28-30, as shown in FIG. 30(*b*), produces a single-layer structure from a metal film 33 that is a different material from that of the beam portion 23 and the movable electrode 24.

Another method for the manufacture of the micro electromechanical relay 10 will be described while referring to FIGS. 31 and 32. The manufacturing steps of the base 11 are the same as the manufacturing steps shown in FIG. 28, and thus explanation of these manufacturing steps will be omitted.

Figure 31A:
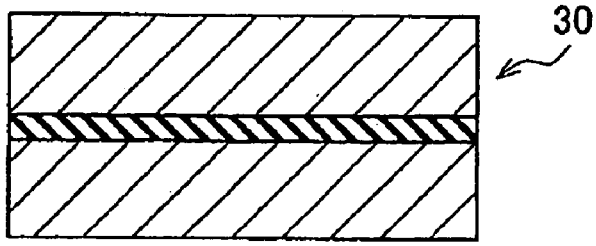
FIGS. 31(*a*) and (*b*) are cross-sectional views showing an example of the manufacturing steps of the actuator.
Figure 31B:
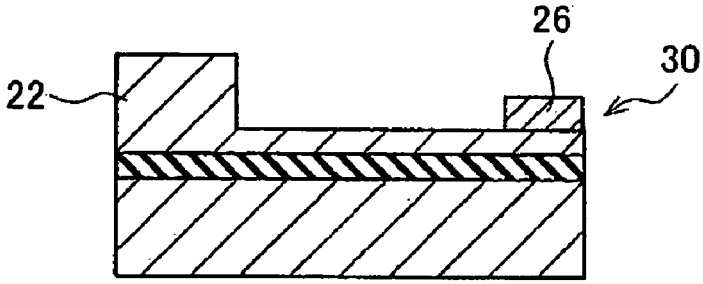

FIGS. 31(*a*) and (*b*) show one example of the manufacturing steps of the actuator 21. Firstly, as shown in FIG. 31(*a*), the SOI wafer 30 is prepared. Thereafter, as shown in FIG. 31(*b*), the silicon oxide film, for example, is etched using TMAH, while using the silicon oxide film as a mask, to form the supporting portion 22. Thereafter, an insulation film and a metal film are formed, and the pattern of the movable contact 26 is formed.

Figure 32A:
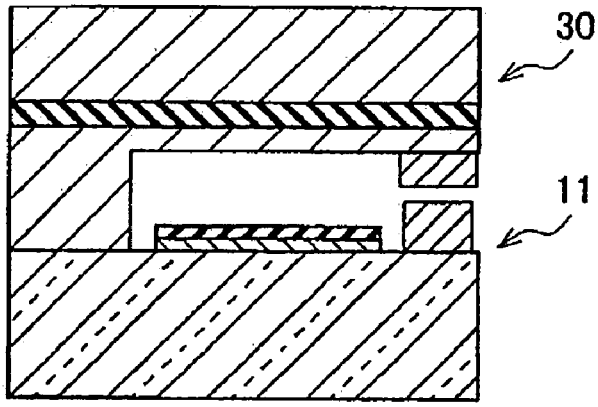
FIGS. 32(*a*) and (*b*) are cross-sectional views showing an example of the connecting steps of the base and the actuator.
Figure 32B:
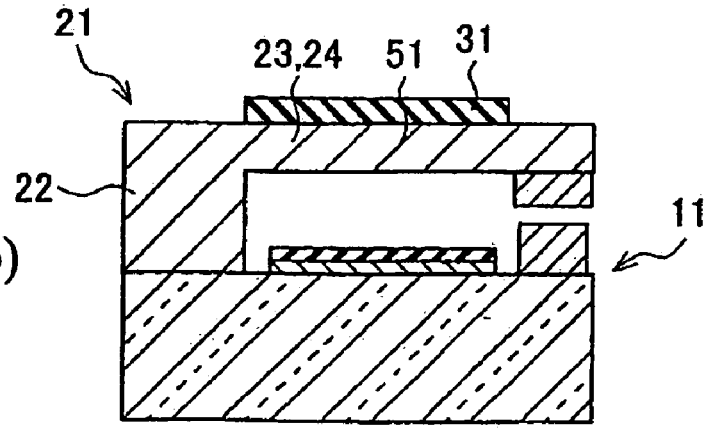

FIGS. 32(*a*) and (*b*) show one example of manufacturing steps of the base 11 and the actuator 21. Firstly, as shown in FIG. 32(*a*), the SOI wafer 30 is bonded to the base 11 by the anodic bonding method to form a single unit. Thereafter, as shown in FIG. 32(*b*), the upper face of the SOI wafer 30 is etched by an alkali etching solution (e.g., TMAH, KOH, or the like) such that etching occurs down to the silicon oxide ($SiO_2$) film 31, and further etching using a fluoride type etching solution removes the silicon oxide film 31 outside of the region corresponding to the connecting part 51 to expose the beam portion 23, the movable electrode 24, and the movable contact portion 25. Thereafter, dry etching using RIE or the like is carried out to form the required etched-away parts (not illustrated) to complete the micro electromechanical relay 10.

Thus, the connecting part 51 manufactured by the manufacturing method shown in FIGS. 31-32, as shown in FIG. 32 (*b*), has a layered structure comprising a compression-stressed film of silicon oxide film 31 formed on the same silicon layer as that of the beam portion 23 and the movable electrode 24.

Another method for the manufacture of the micro electromechanical relay 10 will be described while referring to FIGS. 33 and 34. The manufacturing steps of the base 11 are the same as the manufacturing steps shown in FIG. 28, and thus explanation of these manufacturing steps will be omitted.

Figure 33A:
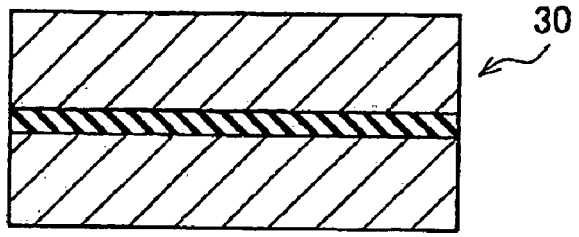
FIGS. 33(*a*) and (*b*) are cross-sectional views showing an example of the manufacturing steps of the actuator.
Figure 33B:
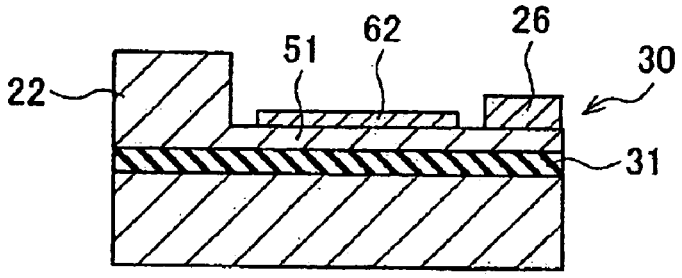

FIGS. 33(*a*) and (*b*) show one example of manufacturing steps of the actuator 21. Firstly, as shown in FIG. 33(*a*), the SOI wafer 30 is prepared. Thereafter, as shown in FIG. 33(*b*), the upper face of the SOI wafer 30 is etched, for example, is etched using TMAH, while using the silicon oxide film as a mask, to form the supporting portion 22. Thereafter, an insulation film and a metal film are formed, and the pattern of the movable contact 26 is formed. Simultaneous with this patterning step, the pattern of a metal film 62 is also formed in a region corresponding to the connecting part 51.

Figure 34A:
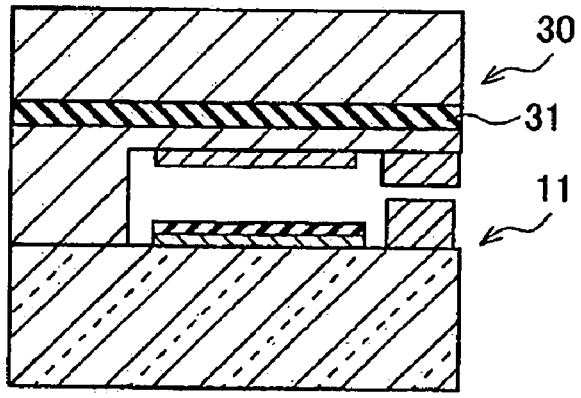
FIGS. 34(*a*) and (*b*) are cross-sectional drawings showing an example of the connecting steps of the base and the actuator.
Figure 34B:
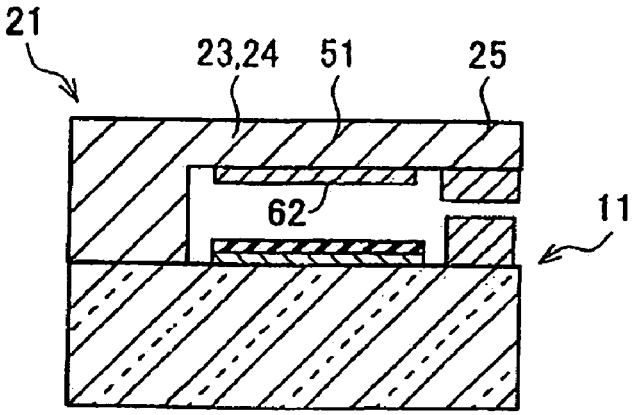

FIGS. 34(*a*) and (*b*) show one example of manufacturing steps of the base 11 and the actuator 21. Firstly, as shown in FIG. 34(*a*), the SOI wafer 30 is bonded to the base 11 by the anodic bonding method to form a single unit. Thereafter, as shown in FIG. 34(*b*), the upper face of the SOI wafer 30 is etched by an alkali etching solution (e.g., TMAH, KOH, or the like) such that etching occurs down to the silicon oxide ($SiO_2$) film 31, and further etching using a fluoride type etching solution removes the silicon oxide film 31 to expose the beam portion 23, the movable electrode 24, and the movable contact portion 25. Thereafter, dry etching using RIE or the like is carried out to form the required etched-away parts (not illustrated) to complete the micro electromechanical relay 10.

Thus, the connecting part 51 manufactured by the manufacturing method shown in FIGS. 33 and 34, as shown in FIG. 34(*b*), has a layered structure comprising the same silicon layer that forms the beam portion 23 and the movable electrode 24 and the metal film 62 that is formed on the surface of the silicon layer that faces the base 11. It is also permissible to use another tensile-stress film (e.g., SiN, etc.) in place of the metal film 62.

EMBODIMENT 8

Another embodiment of the present invention will be explained with reference to FIG. 35. The micro electromechanical relay 10 of the present embodiment differs from the micro electromechanical relay 10 shown in FIG. 21 in that the contact structure is a singleplex structure. Elements having the same function as those explained for the above-mentioned embodiments are designated by the same references, and further explanation of such elements will be omitted.

Figure 35A:
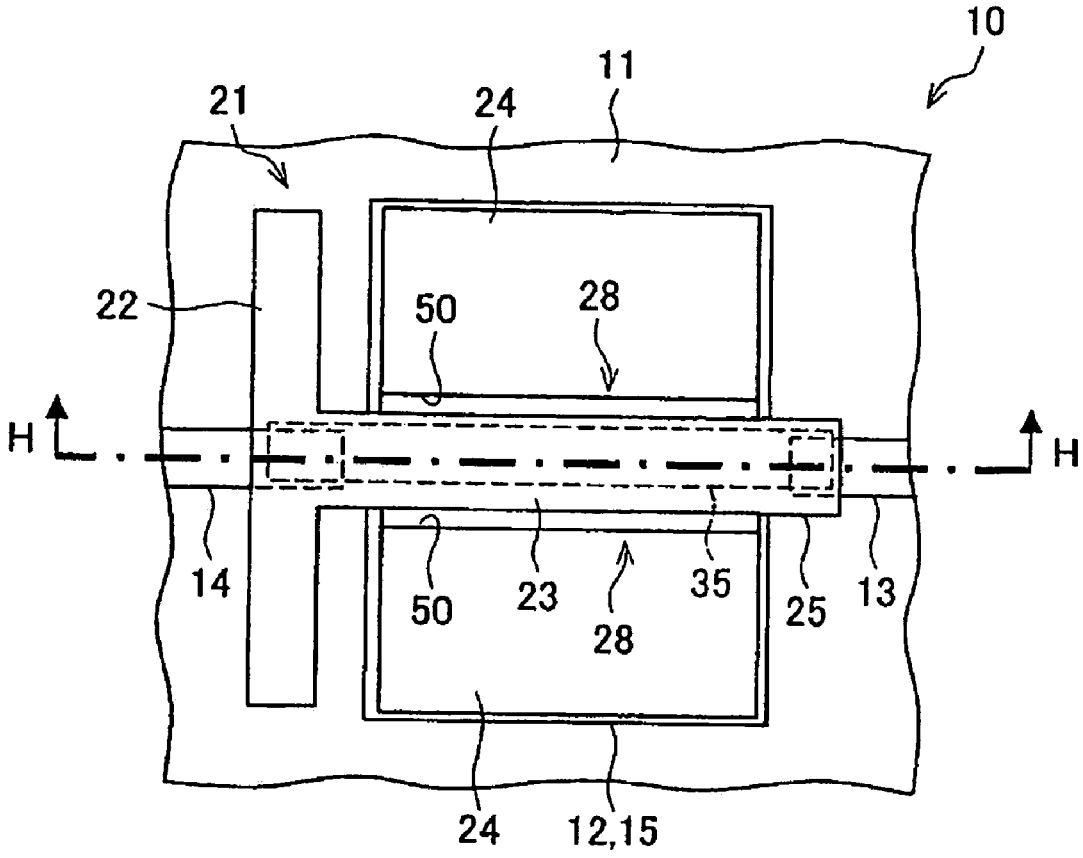
FIG. 35 shows a structure of a micro electromechanical relay according to an embodiment of the present invention.
Figure 35B:
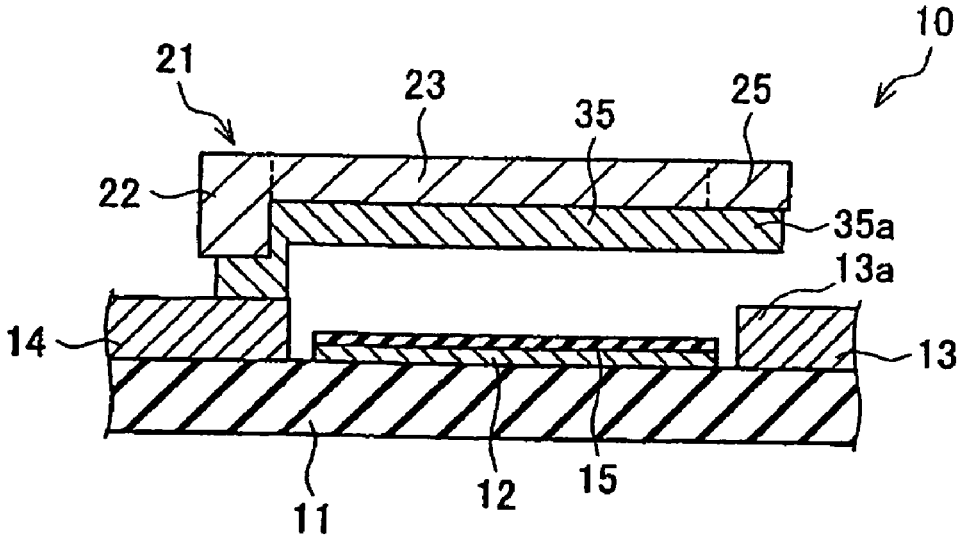

FIG. 35 shows schematically the micro electromechanical relay 10 of the present embodiment. As shown in this figure, the signal lines 13 and 14 are disposed on the base 11 of the micro electromechanical relay 10 co-linearly with the beam portion 23 so that the signals lines 13 and 14 sandwich the fixed electrodes 12. The part of the signal line 13 opposite to the signal line 14 serves as the fixed contact 13*a*.

A signal line 35, formed from an electrical conductor through an intermediary insulating film (not illustrated), is formed at the bottom face of the actuator 21 from the center of the supporting portion 22 along the beam portion 23 to the movable contact portion 25. The signal line 35 is connected electrically to the signal line 14 of the base 11, and the bottom face part of the movable contact portion 25 (i.e., the part opposite to the fixed contact 13*a* of the signal line 13) serves as a movable contact 35*a*.

When a voltage is applied between the movable electrode 24 and the fixed electrode 12 of the micro electromechanical relay 10, the movable contact portion 25 moves, and the movable contact 35*a* and the fixed contact 13*a* contact one another. Thus, the signal lines 13 and 14 become connected together electrically through the signal line 35. The micro electromechanical relay 10 of the present embodiment has a singleplex structure, wherein the movable contact 35*a* contacts and separates from a single fixed contact 13*a*. The micro electromechanical relay 10 of the present embodiment has improved contact reliability due to a low number of contacts in comparison to the micro electromechanical relay 10 shown in FIG. 21.

EMBODIMENT 9

Figure 36:
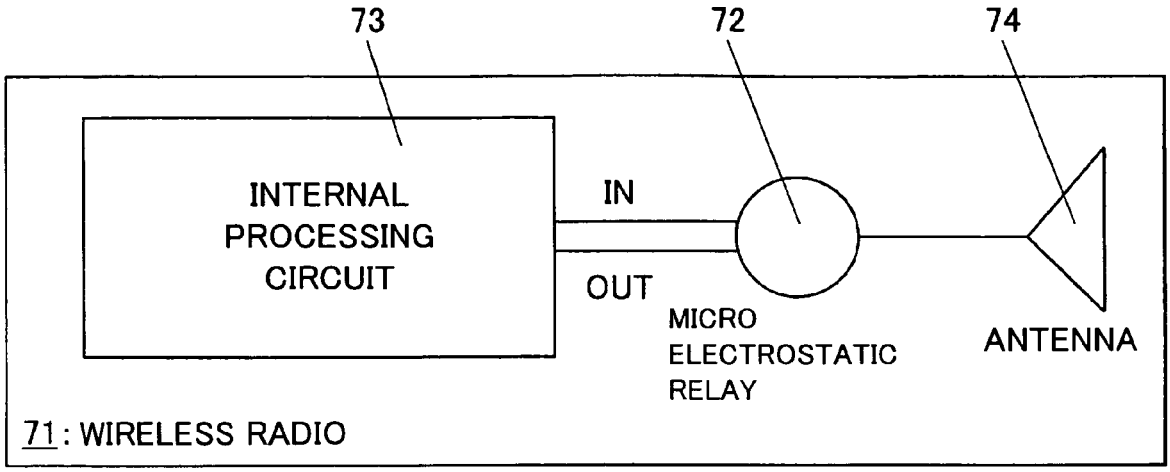
FIG. 36 is a block diagram schematically showing composition of a wireless radio according to an embodiment of the present invention.

Another embodiment of the present invention will be explained next with reference to FIG. 36. FIG. 36 schematically shows a configuration of a wireless radio 71 of the present embodiment. A micro electromechanical relay 72 of the wireless radio 71 connects together an internal processing circuit 73 and an antenna 74. By way of ON/OFF switching of the micro electromechanical relay 72, there is switching of the internal processing circuit 73 between a state capable of signal transmission or reception through the antenna 74 and a state incapable of signal transmission or reception.

According to the present embodiment, any of the micro electromechanical relays 10 shown in FIG. 1-FIG. 35 can be used as the micro electromechanical relay 72. Thus, the operational voltage of the micro electromechanical relay 72 can be lowered and also the shape and size of the micro electromechanical relay 72 can be downsized. Accordingly, it becomes possible to lower power consumption and reduce the size of the wireless radio 71.

EMBODIMENT 10

Figure 37:
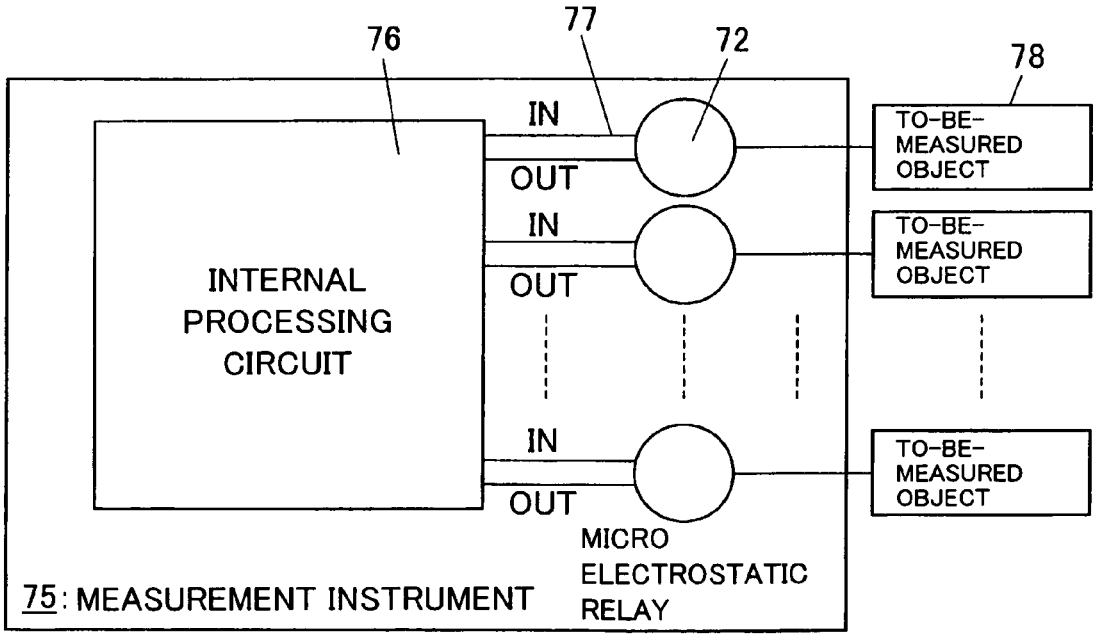
FIG. 37 is a block diagram schematically showing composition of a measurement instrument according to an embodiment of the present invention.

Another embodiment of the present invention will be explained with reference to FIG. 37. FIG. 37 schematically shows a configuration of a measurement instrument 75 of the present embodiment. A multiplicity of micro electromechanical relays 72 are interposed within a multiplicity of signal lines 77, respectively, between a single internal processing circuit 76 and a multiplicity of to-be-measured objects 78. By way of ON/OFF switching of each of the micro electromechanical relays 72, there is switching of the internal processing circuit 76 between the to-be-measured objects 78 for signal transmission or reception.

According to the present embodiment, any of the micro electromechanical relays 10 shown in FIGS. 1-35 can be used as the micro electromechanical relay 72. Thus, the operational voltage of the micro electromechanical relay 72 can be lowered, and also the shape and size of the micro electromechanical relay can be downsized. Accordingly, it becomes possible to lower power consumption and reduce the size of the measurement instrument 75.

EMBODIMENT 11

Figure 38:
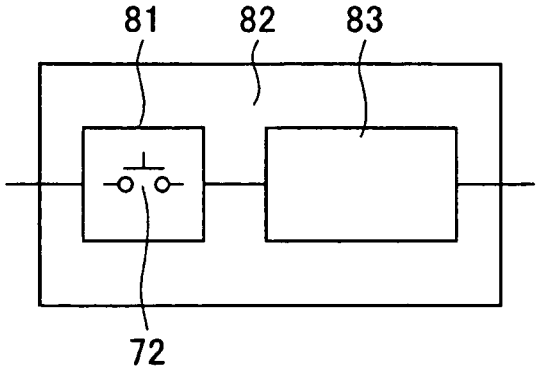
FIG. 38 is a block diagram schematically showing composition of a temperature controller according to an embodiment of the present invention.

Another embodiment of the present invention will be explained next while referring to FIG. 38. FIG. 38 schematically shows a configuration of a temperature controller (temperature sensor) 81 of the present embodiment. The temperature controller 81 is installed in a device (referred to hereinafter simply as a "subject device") 82 that requires a safety function with respect to temperature (e.g., electrical power supply device, controller, or the like) for control of temperature of the subject device 82. As shown in the figure, based on temperature of the subject device 82, the temperature controller 81 is equipped with the micro electromechanical relay 72 for ON/OFF switching of electrical power supply to an internal circuit 83 of the subject device 82.

For example, one case that may be considered of an operating condition of the subject device 82 is the provision that operation should be within a time interval of 1 hour when temperature is greater than or equal to 100° C. When the temperature controller 81 measures the temperature of the subject device 82 and senses that the subject device 82 has run for 1 hour at a temperature greater than or equal to 100° C., the micro electromechanical relay 72 within the temperature controller 82 interrupts the supply of electricity to the internal circuit 83 of the subject device 82.

According to the present embodiment, any of the micro electromechanical relays 10 shown in FIG. 1-FIG. 35 can be used as the micro electromechanical relay 72. Thus, the operational voltage of the micro electromechanical relay 72 can be lowered, and also the shape and size of the micro electromechanical relay 72 can be downsized. Accordingly, it becomes possible to lower power consumption and reduce the size of the temperature controller 81.

EMBODIMENT 12

Figure 39:
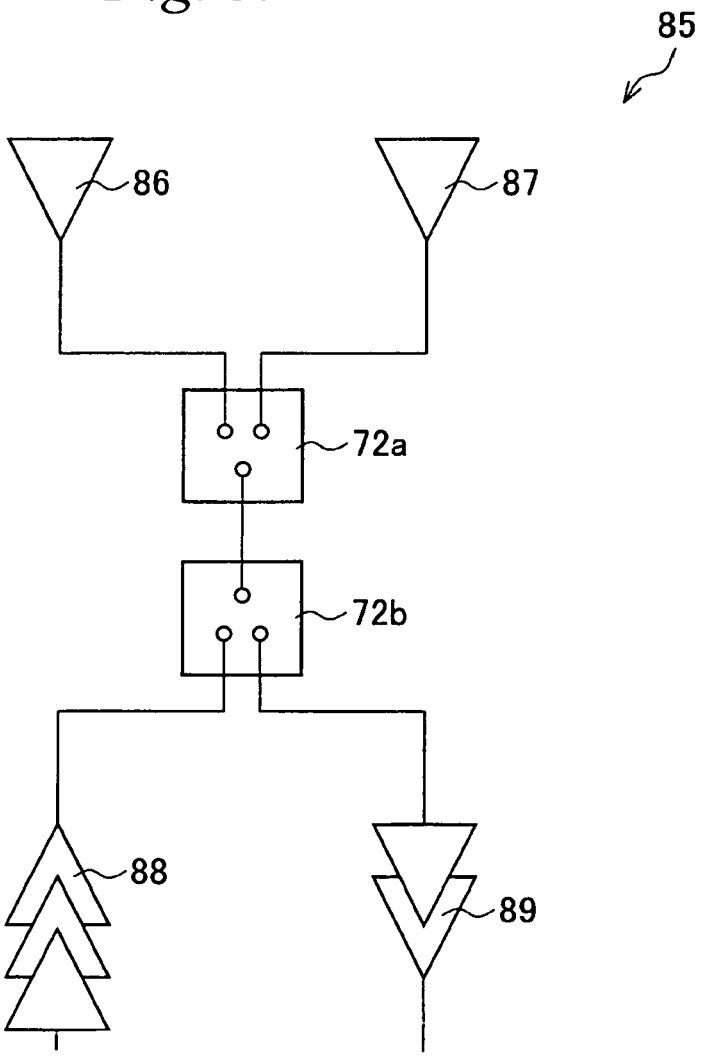
FIG. 39 is a block diagram schematically showing the relevant composition of a portable data terminal according to an embodiment of the present invention.

Another embodiment of the present invention will be explained with reference to FIG. 39. FIG. 39 schematically shows a relevant configuration of a portable data terminal 85 of the present embodiment. The portable data terminal utilizes a pair of micro electromechanical relays 72*a* and 72*b*. The micro electromechanical relay 72*a* switches between an internal antenna 86 and an external antenna 87, and the (other) micro electromechanical relay 72*b* switches between a signal transmission circuit-side electrical power amplifier 88 and a signal reception circuit-side low noise amplifier 89.

According to the present embodiment, any of the micro electromechanical relays 10 shown in FIGS. 1-35 can be used as the micro electromechanical relays 72*a* and 72*b*. Thus, the operational voltage of the micro electromechanical relays 72*a* and 72*b* can be lowered, and also the shape and size of the micro electromechanical relays 72*a* and 72*b* can be downsized. Accordingly, it becomes possible to lower power consumption and reduce the size of the portable data terminal 85.

As explained above, the micro electromechanical relay 10 according to the present invention, while maintaining restorative force equivalent to that used previously, is capable of improving contact force, lowering applied voltage, and/or reducing dimensions of the electrodes. Thus, by use of the micro electromechanical relay 10 of the present embodiment for various types of devices (e.g., wireless radio, measurement instrument, temperature controller, portable data terminal, or the like), power consumption and size of the device can be reduced.

The present invention is not limited to the above-mentioned embodiments, and various types of modifications are possible within the scope of the claims. Embodiments obtained by suitable combination of the technical means disclosed in different respective embodiments are also covered by the scope of the present invention.

For example, although the above-mentioned embodiments explained the micro electromechanical relay, the present invention can be used appropriately for any type of micro electromechanical switch that opens and closes an electrical circuit by causing contact and separation between contacts by the use of electrostatic attraction.

Further, according to the above mentioned embodiments, width of the movable contact portion 25 was greater than width of the beam portion 23. This may allow easy distinction between the movable contact portion 25 and the beam portion 23. It is also permissible for the width of the movable contact portion 25 to be the same or smaller than the width of the beam portion 23.

Furthermore, according to the above mentioned embodiments, most parts of the beam portion 23 oppose the fixed electrode 12, and when a voltage is applied between the beam portion 23 and the fixed electrode 12, the beam portion 23 is driven toward the fixed electrode 12 by electrostatic attraction. Thus, the portion of the beam 23 opposite to the fixed electrode 12 has a function as the movable electrode 24.

POSSIBILITY OF INDUSTRIAL USE

As explained above, the micro electromechanical switch according to the present invention, while maintaining restorative force equivalent to that used previously, is capable of improving contact force, lowering applied voltage, and/or reducing dimensions of the electrodes. Thus, the micro electromechanical switch according the present invention is suitable for use as a MEMS element requiring low electrical power consumption, size reduction, or the like.

What is claimed is:

1. An electromechanical switch comprising:

a base;

a fixed contact disposed on the base;

a fixed electrode disposed on the base;

an actuator comprising a supporting portion disposed on the base, a beam portion extending from the supporting portion, and a movable electrode connected to the beam portion and facing the fixed electrode, wherein the beam portion is displaced in accordance with a displacement of the movable electrode by electrostatic attraction caused between the fixed electrode and the movable electrode; and a movable contact disposed on an end portion of the beam portion and facing the fixed contact so as to come into contact wit the fixed contact based on the displacement of the beam portion, wherein a slit is configured between the beam portion and the movable electrode, the slit is elongated between the beam portion and the movable electrode from a connecting portion that connects the beam portion and the movable electrode to an end portion of the movable electrode that is located on a side where the beam portion extends from supporting portion, the slit is configured such that the movable electrode is disconnected from the beam portion on the side where the beam portion extends from the supporting portion, the end portion of the movable electrode that is located on the side where the beam portion extends from supporting portion is freely movable with respect to the beam portion, and the movable contact and the supporting portion are linearly connected by the beam portion.

2. The electromechanical switch according to claim 1, wherein the movable electrode is configured such that an outer portion of the movable electrode is displaced toward the fixed electrode initially by the electrostatic attraction.

3. The electromechanical switch according to claim 1, wherein a Length of the slit is approximately 37% or more of a length of the movable electrode in a direction extending along the beam portion.

4. The electromechanical switch according to claim 3, wherein a length of the slit is approximately 60% or more of a length of the movable electrode in a direction extending along the beam portion.

5. The electromechanical switch according to claim 4, wherein a length of the slit is approximately 70% or more of a length of the movable electrode in a direction extending along the beam portion.

6. The electromechanical switch according to claim 3, wherein a length of the slit is approximately between 70% and 90% of a length of the movable electrode in a direction extending along the beam portion.

7. The electromechanical switch according to claim 1, wherein the slit does not fully penetrate a thickness of the beam portion and the movable electrode.

8. The electromechanical switch according to claim 1, wherein a portion at which the beam portion and the movable electrode are connected is different in at least one of material and structure from other portions of at least one of the beam portion and the movable electrode.

9. The electromechanical switch according to claim 8, wherein the portion at which the beam portion and the movable electrode are connected is different in at least one of material and structure from all other portions of at least one of the beam portion and the movable electrode.

10. A device used for switching on and off an electrical circuit, the device comprising the electromechanical switch according to claim 1.

11. An electromechanical switch comprising:

a base;

a fixed contact disposed on the base;

a fixed electrode disposed on the base;

an actuator comprising a supporting portion disposed on the base, a beam portion extending from the supporting portion, a movable electrode facing the fixed electrode, and a connecting portion directly connecting the beam portion and the movable electrode, wherein the beam portion is displaced in accordance with a displacement of the movable electrode by electrostatic attraction caused between the fixed electrode and the movable electrode; and a movable contact disposed on an end portion of the beam portion and facing the fixed contact so as to come into contact with the fixed contact based on the displacement of the beam portion, wherein an elastic constant of the connecting portion is smaller than an elastic constant of at least one of the beam portion and the movable electrode, and the entire connecting portion is thinner than the entire beam portion.

12. The electromechanical switch according to claim 11, wherein the connecting portion is different in at least one of material and structure from other portions of at least one of the beam portion and the movable electrode.

13. The electromechanical switch according to claim 12, wherein the connecting portion is different in at least one of material and structure from all other portions at least one of the beam portion and the movable electrode.

14. The electromechanical switch according to claim 12, wherein the connecting portion is configured to be layered.

15. A method of manufacturing an electromechanical switch comprising:

forming a base;

bonding onto the base an SOI wafer so as to form an actuator, wherein the SOI wafer includes an oxide silicon layer disposed between an upper layer and a lower layer;

removing the upper layer by etching to expose the oxide silicon layer;

removing a portion by etching to leave a predetermined portion of the exposed oxide silicon layer;

forming a beam portion and a movable electrode of the actuator by etching the lower layer, wherein a movable contact and a supporting portion of the actuator are linearly connected by the beam portion and a slit is formed between the beam portion and the movable electrode, wherein the slit is elongated between the beam portion and the movable electrode from a connecting portion that connects the beam portion and the movable electrode to an end portion of the movable electrode that is located on a side where the beam portion extends from supporting portion, wherein the slit is formed such that the movable electrode is disconnected from the beam portion on the side where the beam portion extends from supporting portion, wherein the end portion of the movable electrode that is located on the side is freely movable with respect to the beam portion.

16. The method according to claim 15, wherein the forming of the base includes forming a fixed electrode and a fixed contact on the base.

17. The method according to claim 15, further comprising: forming a supporting member of the actuator by etching the SOI wafer before the SOI wafer is bonded onto the base.

18. The method according to claim 15, wherein the beam portion and the movable electrode are formed so as to be connected via the predetermined portion on which the oxide silicon layer is left.

19. The method according to claim 15, further comprising: forming a metal layer on the predetermined portion which connects the beam portion and the movable electrode.

* * * * *